US010233392B2

(12) United States Patent
Quanci et al.

(10) Patent No.: US 10,233,392 B2
(45) Date of Patent: Mar. 19, 2019

(54) METHOD FOR OPTIMIZING COKE PLANT OPERATION AND OUTPUT

(71) Applicant: SUNCOKE TECHNOLOGY AND DEVELOPMENT LLC, Lisle, IL (US)

(72) Inventors: John Francis Quanci, Haddonfield, NJ (US); Chun Wai Choi, Chicago, IL (US); Parthasarathy Kesavan, Lisle, IL (US); Katharine E. Russell, Lisle, IL (US); Khambath Vichitvongsa, Granite City, IL (US); Jeffrey Scott Brombolich, O'Fallon, IL (US); Richard Alan Mrozowicz, Granite City, IL (US); Edward A. Glass, Granite City, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

(21) Appl. No.: 14/839,493

(22) Filed: Aug. 28, 2015

(65) Prior Publication Data

US 2016/0060536 A1 Mar. 3, 2016

Related U.S. Application Data

(60) Provisional application No. 62/043,359, filed on Aug. 28, 2014.

(51) Int. Cl.
*C10B 37/02* (2006.01)
*C10B 37/04* (2006.01)
(Continued)

(52) U.S. Cl.
CPC ..... *C10B 25/02* (2013.01); *C10B 15/02* (2013.01); *C10B 31/00* (2013.01); *C10B 31/02* (2013.01);
(Continued)

(58) Field of Classification Search
CPC ..... C10B 45/02; C10B 9/00; C10B 37/02; C10B 37/04; C10B 31/00; C10B 31/02;
(Continued)

(56) References Cited

U.S. PATENT DOCUMENTS 469,868 A 3/1892 Thomas et al.
1,140,798 A 5/1915 Carpenter
(Continued)

FOREIGN PATENT DOCUMENTS

CA 2775992 A1 5/2011
CA 2822841 7/2012
(Continued)

OTHER PUBLICATIONS

International Search Report and Written Opinion issued for PCT/US2015/047522 and dated Oct. 26, 2015, 12 pages.
(Continued)

*Primary Examiner* — Jonathan Miller
*Assistant Examiner* — Jonathan Luke Pilcher
(74) *Attorney, Agent, or Firm* — Perkins Coie LLP

(57) ABSTRACT

The present technology is generally directed to methods of increasing coal processing rates for coke ovens. In various embodiments, the present technology is applied to methods of coking relatively small coal charges over relatively short time periods, resulting in an increase in coal processing rate. In some embodiments, a coal charging system includes a charging head having opposing wings that extend outwardly and forwardly from the charging head, leaving an open pathway through which coal may be directed toward side edges of the coal bed. In other embodiments, an extrusion plate is positioned on a rearward face of the charging head and oriented to engage and compress coal as the coal is charged along a length of the coking oven. In other embodiments, a false door system includes a false door that is
(Continued)

vertically oriented to maximize an amount of coal being charged into the oven.

13 Claims, 34 Drawing Sheets

(51) Int. Cl.

| | |
|---|---|
| ***C10B 31/08*** | (2006.01) |
| ***C10B 31/06*** | (2006.01) |
| ***C10B 31/00*** | (2006.01) |
| ***C10B 25/02*** | (2006.01) |
| ***C10B 15/02*** | (2006.01) |
| ***C10B 31/02*** | (2006.01) |
| ***C10B 39/06*** | (2006.01) |
| ***C10B 31/10*** | (2006.01) |
| ***C10B 57/08*** | (2006.01) |
| ***C10B 57/02*** | (2006.01) |
| ***C10B 35/00*** | (2006.01) |
| ***C10B 41/00*** | (2006.01) |
| *C10B 5/00* | (2006.01) |
| *C10B 15/00* | (2006.01) |

(52) U.S. Cl.
CPC ..... *C10B 31/06* (2013.01); *C10B 31/08* (2013.01); *C10B 31/10* (2013.01); *C10B 35/00* (2013.01); *C10B 37/02* (2013.01); *C10B 37/04* (2013.01); *C10B 39/06* (2013.01); *C10B 41/00* (2013.01); *C10B 57/02* (2013.01); *C10B 57/08* (2013.01); *C10B 5/00* (2013.01); *C10B 15/00* (2013.01)

(58) Field of Classification Search
CPC ..... C10B 31/04; C10B 31/06; C10B 31/08; C10B 15/00; C10B 15/02
See application file for complete search history.

(56) References Cited

U.S. PATENT DOCUMENTS 1,424,777 A 8/1922 Schondeling
1,430,027 A 9/1922 Plantinga
1,486,401 A 3/1924 Van Ackeren
1,572,391 A 2/1926 Klaiber
1,721,813 A 7/1929 Rudolf et al.
1,818,370 A 8/1931 Wine
1,818,994 A 8/1931 Kreisinger
1,848,818 A 3/1932 Becker
1,955,962 A 4/1934 Jones
2,075,337 A 3/1937 Burnaugh
2,394,173 A 2/1946 Harris
2,424,012 A 7/1947 Bangham et al.
2,667,185 A 1/1954 Beavers
2,723,725 A 11/1955 Keiffer
2,756,842 A 7/1956 Chamberlin et al.
2,873,816 A 2/1959 Emil et al.
2,902,991 A 9/1959 Whitman
3,015,893 A 1/1962 McCreary
3,033,764 A 5/1962 Hannes
3,462,345 A 8/1969 Kernan
3,511,030 A 5/1970 Brown et al.
3,545,470 A 12/1970 Paton
3,616,408 A 10/1971 Hickam
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A * 1/1974 Thompson ..... C10B 35/00 201/40
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,506 A 4/1975 Ernst et al.
3,878,053 A 4/1975 Hyde
3,894,302 A 7/1975 Lasater
3,897,312 A 7/1975 Armour
3,906,992 A 9/1975 Leach
3,912,091 A 10/1975 Thompson
3,917,458 A 11/1975 Polak
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach et al.
3,975,148 A 8/1976 Fukuda et al.
3,984,289 A 10/1976 Sustarsic et al.
4,004,702 A 1/1977 Szendroi
4,004,983 A 1/1977 Pries
4,040,910 A 8/1977 Knappstein et al.
4,059,885 A 11/1977 Oldengott
4,067,462 A 1/1978 Thompson
4,083,753 A 4/1978 Rogers et al.
4,086,231 A 4/1978 Ikio
4,100,033 A 7/1978 Holter
4,111,757 A 9/1978 Ciarimboli
4,124,450 A * 11/1978 MacDonald ..... C10B 15/02 201/15
4,141,796 A 2/1979 Clark et al.
4,145,195 A 3/1979 Knappstein et al.
4,147,230 A 4/1979 Ormond et al.
4,162,546 A 7/1979 Shortell et al.
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,303,615 A 12/1981 Jarmell et al.
4,307,673 A 12/1981 Caughey
4,314,787 A 2/1982 Kwasnick et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng

(56) References Cited

U.S. PATENT DOCUMENTS 4,469,446 A 9/1984 Goodboy
4,498,786 A 2/1985 Ruscheweyh
4,508,539 A 4/1985 Nakai
4,527,488 A 7/1985 Lindgren
4,568,426 A 2/1986 Orlando et al.
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando et al.
4,704,195 A 11/1987 Janicka et al.
4,720,262 A 1/1988 Durr et al.
4,726,465 A 2/1988 Kwasnik et al.
4,793,931 A 12/1988 Doyle et al.
4,824,614 A 4/1989 Jones et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childrss et al.
5,227,106 A 7/1993 Kolvek
5,228,955 A 7/1993 Westbrook
5,318,671 A 6/1994 Pruitt
5,447,606 A 9/1995 Prutt et al.
5,480,594 A 1/1996 Wilkerson et al.
5,622,280 A 4/1997 Mays et al.
5,670,025 A 9/1997 Baird
5,687,768 A 11/1997 Albrecht et al.
5,787,821 A 8/1998 Bhat et al.
5,810,032 A 9/1998 Hong et al.
5,857,308 A 1/1999 Dismore et al.
5,928,476 A 7/1999 Daniels
5,968,320 A 10/1999 Sprague
6,017,214 A 1/2000 Sturgulewski
6,059,932 A * 5/2000 Sturgulewski ..... C10B 15/02 201/40
6,139,692 A 10/2000 Tamura et al.
6,152,668 A 11/2000 Knoch
6,187,148 B1 2/2001 Sturgulewski
6,189,819 B1 2/2001 Racine
6,290,494 B1 9/2001 Barkdoll
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
6,964,236 B2 * 11/2005 Schucker ..... C10B 37/02 110/101 R
7,056,390 B2 6/2006 Fratello
7,077,892 B2 7/2006 Lee
7,314,060 B2 1/2008 Chen et al.
7,331,298 B2 2/2008 Taylor et al.
7,497,930 B2 3/2009 Barkdoll et al.
7,611,609 B1 11/2009 Valia et al.
7,644,711 B2 1/2010 Creel
7,727,307 B2 6/2010 Winkler
7,803,627 B2 9/2010 Hodges
7,827,689 B2 11/2010 Crane et al.
7,998,316 B2 8/2011 Barkdoll et al.
8,071,060 B2 12/2011 Ukai et al.
8,079,751 B2 12/2011 Kapila et al.
8,152,970 B2 4/2012 Barkdoll et al.
8,236,142 B2 8/2012 Westbrook et al.
8,266,853 B2 9/2012 Bloom et al.
8,398,935 B2 3/2013 Howell, Jr. et al.
2002/0170605 A1 11/2002 Shiraishi et al.
2003/0014954 A1 1/2003 Ronning et al.
2003/0015809 A1 1/2003 Carson
2006/0102420 A1 5/2006 Huber et al.
2007/0116619 A1 5/2007 Taylor et al.
2007/0251198 A1 11/2007 Witter
2008/0028935 A1 2/2008 Andersson
2008/0169578 A1 7/2008 Crane et al.
2008/0179165 A1 7/2008 Chen et al.
2008/0257236 A1 10/2008 Green
2008/0271985 A1 11/2008 Yamasaki
2008/0289305 A1 11/2008 Girondi
2009/0152092 A1 6/2009 Kim et al.
2009/0217576 A1 9/2009 Kim et al.
2009/0283395 A1 11/2009 Hippe
2010/0095521 A1 4/2010 Bertini et al.
2010/0115912 A1 5/2010 Worley et al.
2010/0287871 A1 11/2010 Bloom et al.
2010/0300867 A1 12/2010 Kim et al.
2011/0048917 A1 3/2011 Kim et al.
2011/0120852 A1 5/2011 Kim et al.
2011/0174301 A1 7/2011 Haydock et al.
2011/0192395 A1 8/2011 Kim et al.
2011/0223088 A1 9/2011 Chang et al.
2011/0253521 A1 10/2011 Kim
2011/0315538 A1 12/2011 Kim et al.
2012/0024688 A1 2/2012 Barkdoll
2012/0030998 A1 2/2012 Barkdoll et al.
2012/0152720 A1 6/2012 Reichelt et al.
2012/0228115 A1 9/2012 Westbrook
2012/0305380 A1 12/2012 Wang et al.
2013/0216717 A1 8/2013 Rago et al.
2013/0306462 A1 11/2013 Kim
2014/0033917 A1 2/2014 Rodgers et al.
2014/0048402 A1 2/2014 Quanci et al.
2014/0048404 A1 2/2014 Quanci et al.
2014/0048405 A1 2/2014 Quanci et al.
2014/0061018 A1 3/2014 Sarpen et al.
2014/0083836 A1 3/2014 Quanci et al.
2014/0182195 A1 7/2014 Quanci et al.
2014/0182683 A1 7/2014 Quanci et al.
2014/0183023 A1 7/2014 Quanci et al.
2014/0183024 A1 7/2014 Chun et al.
2014/0183026 A1 7/2014 Quanci et al.
2014/0224123 A1 8/2014 Walters
2014/0262139 A1 9/2014 Choi et al.
2014/0262726 A1 9/2014 West et al.
2015/0122629 A1 5/2015 Freimuth et al.
2015/0247092 A1 9/2015 Quanci et al.
2015/0287026 A1 10/2015 Yang et al.

FOREIGN PATENT DOCUMENTS

CA 2822857 A1 7/2012
CN 2064363 U 10/1990
CN 1092457 A 9/1994
CN 1255528 A 6/2000
CN 1358822 A 7/2002
CN 2509188 Y 9/2002
CN 2528771 Y 1/2003
CN 1468364 A 1/2004
CN 2668641 Y 1/2005
CN 101157874 A 4/2008
CN 202226816 U 5/2012
DE 212176 C 7/1909
DE 3315738 A1 11/1983
DE 3231697 C1 1/1984
DE 3329367 C1 11/1984
DE 19545736 A1 6/1997
DE 19803455 C1 8/1999
DE 10154785 A1 5/2003
DE 102009031436 A1 1/2011
DE 102011052785 B3 12/2012
FR 2339664 A1 8/1977
GB 441784 A 1/1936
GB 606340 A 8/1948
GB 611524 A 11/1948
GB 725865 A 3/1955
GB 871094 A 6/1961
JP 50148405 A 11/1975
JP 54054101 A 4/1979
JP 57051786 A 3/1982

(56) References Cited

FOREIGN PATENT DOCUMENTS

| | | | |
|---|---|---|---|
| JP | 57051787 | A | 3/1982 |
| JP | 57083585 | A | 5/1982 |
| JP | 57090092 | A | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 60004588 | A | 1/1985 |
| JP | 61106690 | A | 5/1986 |
| JP | 62011794 | A | 1/1987 |
| JP | 62285980 | A | 12/1987 |
| JP | 01103694 | A | 4/1989 |
| JP | 01249886 | A | 10/1989 |
| JP | H0319127 | A | 1/1991 |
| JP | 07188668 | A | 7/1995 |
| JP | 07216357 | A | 8/1995 |
| JP | 08127778 | A | 5/1996 |
| JP | 2000204373 | A | 7/2000 |
| JP | 2001200258 | A | 7/2001 |
| JP | 03197588 | A | 8/2001 |
| JP | 2002106941 | A | 4/2002 |
| JP | 200341258 | A | 2/2003 |
| JP | 2003071313 | A | 3/2003 |
| JP | 04159392 | A | 10/2008 |
| JP | 2009144121 | A | 7/2009 |
| JP | 2012102302 | A | 5/2012 |
| KR | 1019990054426 | A | 7/1999 |
| KR | 20000042375 | A | 7/2000 |
| KR | 100296700 | B1 | 10/2001 |
| KR | 100797852 | B1 | 1/2008 |
| KR | 10-2011-0010452 | A | 2/2011 |
| KR | 10-0296700 | A1 | 10/2011 |
| KR | 101318388 | B1 | 10/2013 |
| WO | 9012074 | A1 | 10/1990 |
| WO | 9945083 | A1 | 9/1999 |
| WO | WO2005115583 | | 12/2005 |
| WO | 2007103649 | A2 | 9/2007 |
| WO | 2008034424 | A1 | 3/2008 |
| WO | 2010107513 | A1 | 9/2010 |
| WO | 2011000447 | A1 | 1/2011 |
| WO | 2012029979 | A1 | 3/2012 |
| WO | 2013023872 | A1 | 2/2013 |

OTHER PUBLICATIONS

U.S. Appl. No. 14/655,003, filed Jun. 23, 2015, Ball, Mark A., et al.
U.S. Appl. No. 14/655,013, filed Jun. 23, 2015, West, Gary D., et al.
U.S. Appl. No. 14/655,204, filed Jun. 24, 2015, Quanci, John F., et al.
U.S. Appl. No. 14/839,384, filed Aug. 28, 2015, Quanci, John F., et al.
U.S. Appl. No. 14/839,551, filed Aug. 28, 2015, Quanci, John F., et al.
U.S. Appl. No. 14/839,588, filed Aug. 28, 2015, Quanci, John F., et al.
U.S. Appl. No. 14/865,581, filed Sep. 25, 2015, Sarpen, Jacob P., et al.
ASTM D5341-99(2010)e1, Standard Test Method for Measuring Coke Reactivity Index (CRI) and Coke Strength After Reaction (CSR), ASTM International, West Conshohocken, PA, 2010.
Clean coke process: process development studies by USS Engineers and Consultants, Inc., Wisconsin Tech Search, request date Oct. 5, 2011, 17 pages.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
JP 03-197588, Inoqu Keizo et al., Method and Equipment for Boring Degassing Hole in Coal Charge in Coke Oven, Japanese Patent (Abstract Only) Aug. 28, 1991.
JP 04-159392, Inoue Keizo et al., Method and Equipment for Opening Hole for Degassing of Coal Charge in Coke Oven, Japanese Patent (Abstract Only) Jun. 2, 1992.
Rose, Harold J., "The Selection of Coals for the Manufacture of Coke," American Institute of Mining and Metallurgical Engineers, Feb. 1926, 8 pages.
U.S. Appl. No. 14/952,267, filed Nov. 25, 2015, Quanci et al.
U.S. Appl. No. 14/959,450, filed Dec. 4, 2015, Quanci et al.
U.S. Appl. No. 14/983,837, filed Dec. 30, 2015, Quanci et al.
U.S. Appl. No. 14/984,489, filed Dec. 30, 2015, Quanci et al.
U.S. Appl. No. 14/986,281, filed Dec. 31, 2015, Quanci et al.
U.S. Appl. No. 14/987,625, filed Jan. 4, 2016, Quanci et al.
U.S. Appl. No. 15/014,547, filed Feb. 3, 2016, Choi et al.
Basset, et al., "Calculation of steady flow pressure loss coefficients for pipe junctions," Proc Instn Mech Engrs., vol. 215, Part C. IMechIE 2001.
Costa, et al., "Edge Effects on the Flow Characteristics in a 90 deg Tee Junction," Transactions of the ASME, Nov. 2006, vol. 128, pp. 1204-1217.
International Search Report and Written Opinion of International Application No. PCT/US2015/047522; dated Oct. 26, 2015, 12 pages.

* cited by examiner

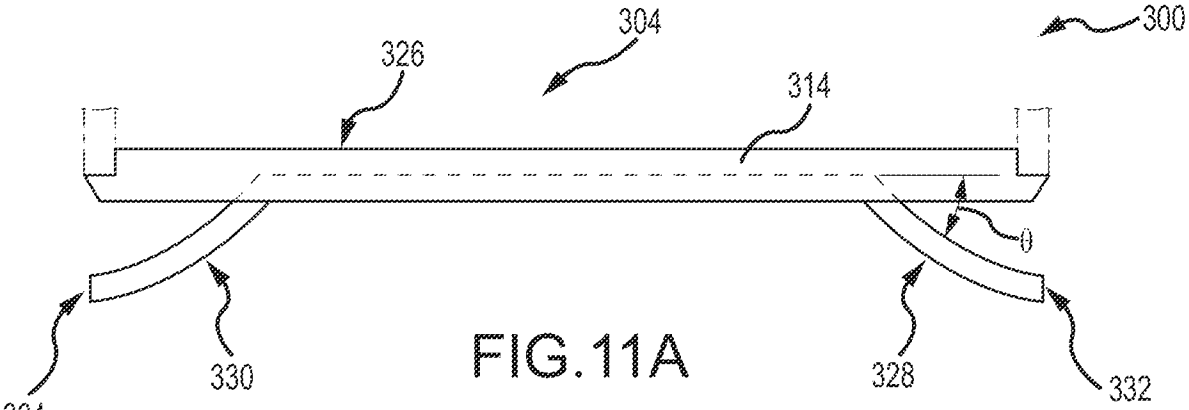
FIG. 11A
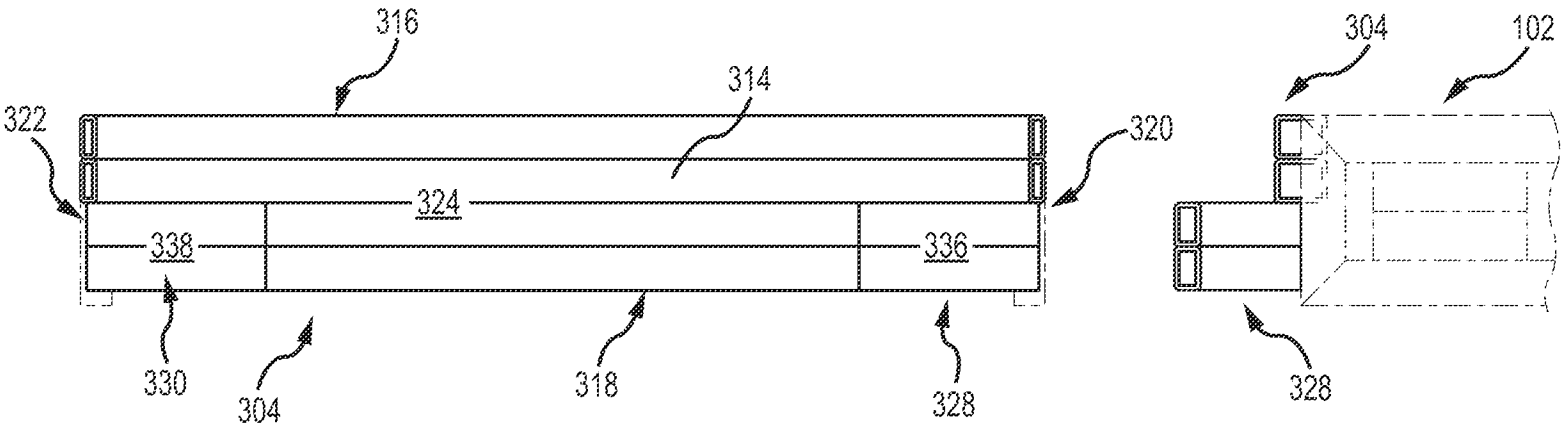
FIG. 11B
FIG. 11C

METHOD FOR OPTIMIZING COKE PLANT OPERATION AND OUTPUT

CROSS-REFERENCE TO RELATED APPLICATIONS

This application claims the benefit of priority to U.S. Provisional Patent Application No. 62/043,359, filed Aug. 28, 2014, the disclosure of which is incorporated herein by reference in its entirety.

TECHNICAL FIELD

The present technology is generally directed to optimizing the operation and output of coke plants.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for approximately forty-eight hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

Much of the coke manufacturing process is automated due to the extreme temperatures involved. For example, a pusher charger machine ("PCM") is typically used on the coal side of the oven for a number of different operations. A common PCM operation sequence begins as the PCM is moved along a set of rails that run in front of an oven battery to an assigned oven and align a coal charging system of the PCM with the oven. The pusher side oven door is removed from the oven using a door extractor from the coal charging system. The PCM is then moved to align a pusher ram of the PCM to the center of the oven. The pusher ram is energized, to push coke from the oven interior. The PCM is again moved away from the oven center to align the coal charging system with the oven center. Coal is delivered to the coal charging system of the PCM by a tripper conveyor. The coal charging system then charges the coal into the oven interior. In some systems, particulate matter entrained in hot gas emissions that escape from the oven face are captured by the PCM during the step of charging the coal. In such systems, the particulate matter is drawn into an emissions hood through the baghouse of a dust collector. The charging conveyor is then retracted from the oven. Finally, the door extractor of the PCM replaces and latches the pusher side oven door.

With reference to FIG. 1, PCM coal charging systems 10 have commonly included an elongated frame 12 that is mounted on the PCM (not depicted) and reciprocally movable, toward and away from the coke ovens. A planar charging head 14 is positioned at a free distal end of the elongated frame 12. A conveyor 16 is positioned within the elongated frame 12 and substantially extends along a length of the elongated frame 12. The charging head 14 is used, in a reciprocal motion, to generally level the coal that is deposited in the oven. However, with regard to FIGS. 2A, 3A, and 4A, the prior art coal charging systems tend to leave voids 16 at the sides of the coal bed, as shown in FIG. 2A, and hollow depressions in the surface of the coal bed. These voids limit the amount of coal that can be processed by the coke oven over a coking cycle time (coal processing rate), which generally reduces the amount of coke produced by the coke oven over the coking cycle (coke production rate). FIG. 2B depicts the manner in which an ideally charged, level coke bed would look.

The weight of coal charging system 10, which can include internal water cooling systems, can be 80,000 pounds or more. When charging system 10 is extended inside the oven during a charging operation, the coal charging system 10 deflects downwardly at its free distal end. This shortens the coal charge capacity. FIG. 3A indicates the drop in bed height caused by the deflections of the coal charging system 10. The plot depicted in FIG. 5 shows the coal bed profile along the oven length. The bed height drop, due to coal charging system deflection, is from five inches to eight inches between the pusher side to the coke side, depending upon the charge weight. As depicted, the effect of the deflection is more significant when less coal is charged into the oven. In general, coal charging system deflection can cause a coal volume loss of approximately one to two tons. FIG. 3B depicts the manner in which an ideally charged, level coke bed would look.

Despite the ill effect of coal charging system deflection, caused by its weight and cantilevered position, the coal charging system 10 provides little benefit in the way of coal bed densification. With reference to FIG. 4A, the coal charging system 10 provides minimal improvement to internal coal bed density, forming a first layer d1 and a second, less dense layer d2 at the bottom of the coal bed. Increasing the density of the coal bed can facilitate conductive heat transfer throughout the coal bed which is a component in determining oven cycle time and oven production capacity. FIG. 6 depicts a set of density measurements taken for an oven test using a prior art coal charging system 10. The line with diamond indicators shows the density on the coal bed surface. The line with the square indicators and the line with the triangular indicators show density twelve inches and twenty-four inches below the surface respectively. The data demonstrates that bed density drops more on the coke side. FIG. 4B depicts the manner in which an ideally charged, level coke bed would look, having relatively increased density layers D1 and D2.

Typical coking operations present coke ovens that coke an average of forty-seven tons of coal in a forty-eight hour period. Accordingly, such ovens are said to process coal at a rate of approximately 0.98 tons/hr, by previously known methods of oven charging and operation. Several factors contribute to the coal processing rate, including the constraints of draft, oven temperature (gas temperature and thermal reserve from the oven brick), and operating temperature limits of the oven sole flue, common tunnel, and associated components, such as Heat Recovery Steam Generators (HRSG). Accordingly, it has heretofore been difficult to attain coal processing rates that exceed 1.0 tons/hr.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified.

FIG. 11A depicts a top plan view of yet another embodiment of a charging head according to the present technology.

FIG. 11B depicts a front elevation view of the charging head depicted in FIG. 11A.

FIG. 11C depicts a side elevation view of the charging head depicted in FIG. 11A.

DETAILED DESCRIPTION

Figure 1:
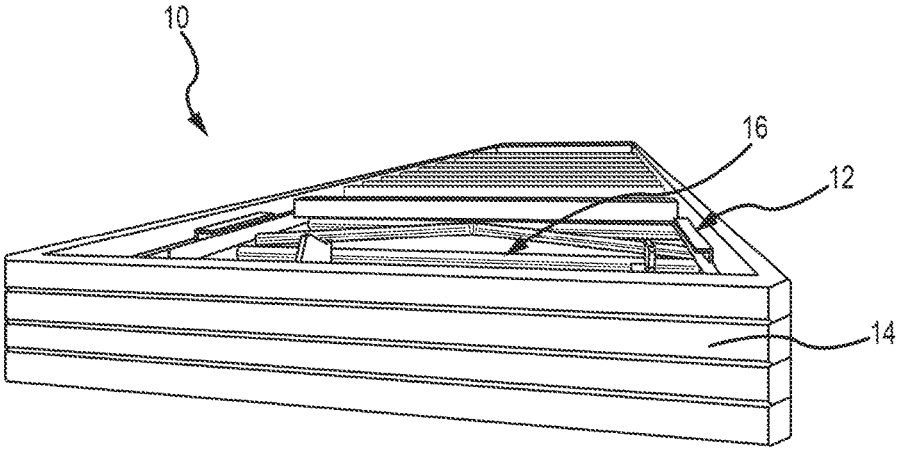
FIG.1 (PRIOR ART)
FIG. 1 depicts a front perspective view of a prior art coal charging system.

The present technology is generally directed to methods of increasing a coal processing rate of coke ovens. In some embodiments, the present technology is applied to methods of coking relatively small coal charges over relatively short time periods, resulting in an increase in coal processing rate. In various embodiments, methods of the present technology, are used with horizontal heat recovery coke ovens. However, embodiments of the present technology can be used with other coke ovens, such as horizontal, non-recovery ovens. In some embodiments, coal is charged into the oven using a coal charging system that includes a charging head having opposing wings that extend outwardly and forwardly from the charging head, leaving an open pathway through which coal may be directed toward the side edges of the coal bed. In other embodiments, an extrusion plate is positioned on a rearward face of the charging head and oriented to engage and compress coal as the coal is charged along a length of the coking oven. In still other embodiments, a false door is vertically oriented to maximize an amount of coal being charged into the oven.

Specific details of several embodiments of the technology are described below with reference to FIGS. 7-29 and 32-37. Other details describing well-known structures and systems often associated with pusher systems, charging systems, and coke ovens have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 7-29 and 32-37.

It is contemplated that the coal charging technology of the present matter will be used in combination with a pusher charger machine ("PCM") having one or more other components common to PCMB, such as a door extractor, a pusher ram, a tripper conveyor, and the like. However, aspects of the present technology may be used separately from a PCM and may be used individually or with other equipment associated with a coking system. Accordingly, aspects of the present technology may simply be described as "a coal charging system" or components thereof. Components associated with coal charging systems, such as coal conveyers and the like that are well-known may not be described in detail, if at all, to avoid unnecessarily obscuring the description of the various embodiments of the technology.

With reference to FIGS. 7-9C, a coal charging system 100 is depicted, having an elongated charging frame 102 and a charging head 104. In various embodiments, the charging frame 102 will be configured to have opposite sides 106 and 108 that extend between a distal end portion 110 and proximal end portion 112. In various applications, the proximal end portion 112 may be coupled with a PCM in a manner that permits selective extension and retraction of the charging frame 102 into, and from within, a coke oven interior during a coal charging operation. Other systems, such as a height adjustment system that selectively adjusts the height of the charging frame 102 with respect to a coke oven floor and/or a coal bed, may also be associated with the coal charging system 100.

The charging head 104 is coupled with the distal end portion 110 of the elongated charging frame 102. In various embodiments, the charging head 104 is defined by a planar body 114, having an upper edge portion 116, lower edge portion 118, opposite side portions 120 and 122, a front face 124, and a rearward face 126. In some embodiments, a substantial portion of the body 114 resides within a charging head plane. This is not to suggest that embodiments of the present technology will not provide charging head bodies having aspects that occupy one or more additional planes. In various embodiments, the planar body is formed from a plurality of tubes, having square or rectangular cross-sectional shapes. In particular embodiments, the tubes are provided with a width of six inches to twelve inches. In at least one embodiment, the tubes have a width of eight inches, which demonstrated a significant resistance to warping during charging operations.

Figure 9A:
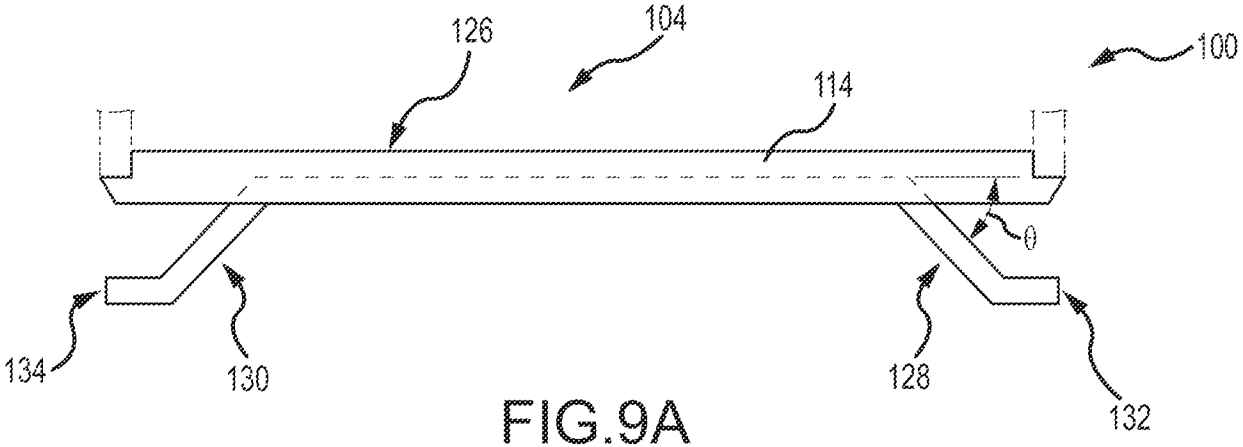
FIG. 9A depicts a top plan view of one embodiment of a charging head according to the present technology.
Figure 9B:
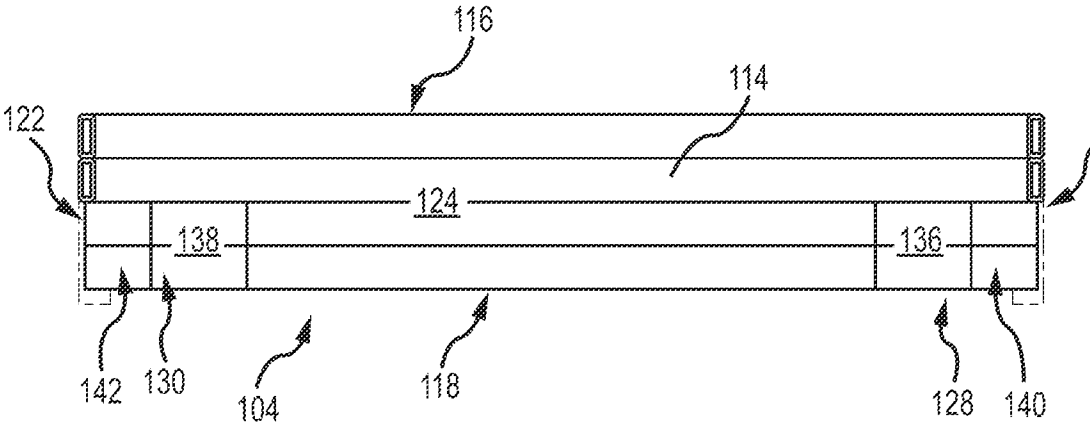
FIG. 9B depicts a front elevation view of the charging head depicted in FIG. 9A.
Figure 9C:
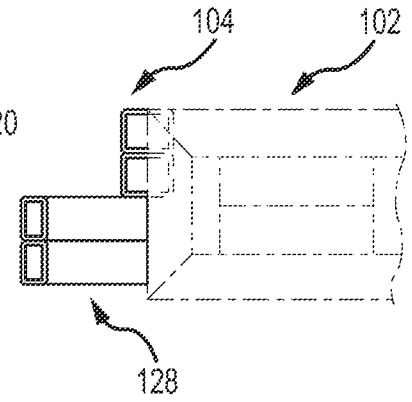
FIG. 9C depicts a side elevation view of the charging head depicted in FIG. 9A.

With further reference to FIGS. 9A-9C, various embodiments of the charging head 104 include a pair of opposing wings 128 and 130 that are shaped to have free end portions 132 and 134. In some embodiments, the free end portions 132 and 134 are positioned in a spaced-apart relationship, forwardly from the charging head plane. In particular embodiments, the free end portions 132 and 134 are spaced forwardly from the charging head plane a distance of six inches to 24 inches, depending on the size of the charging head 104 and the geometry of the opposing wings 128 and 130. In this position, the opposing wings 128 and 130 define open spaces rearwardly from the opposing wings 128 and 130, through the charging head plane. As the design of these open spaces is increased in size, more material is distributed to the sides of the coal bed. As the spaces are made smaller, less material is distributed to the sides of the coal bed. Accordingly, the present technology is adaptable as particular characteristics are presented from coking system to coking system.

Figure 2B:
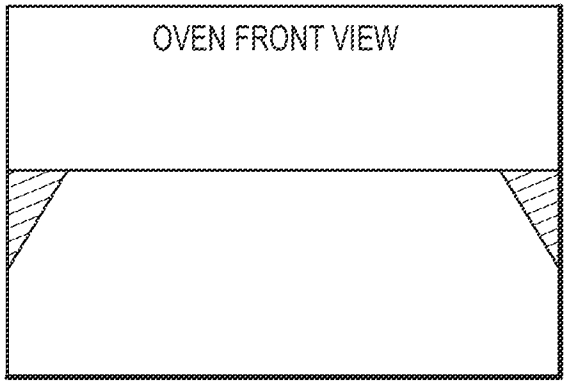
FIG. 2B depicts a front view of a coal bed that was ideally charged into a coke oven, without voids at the sides of the bed.
Figure 2A:
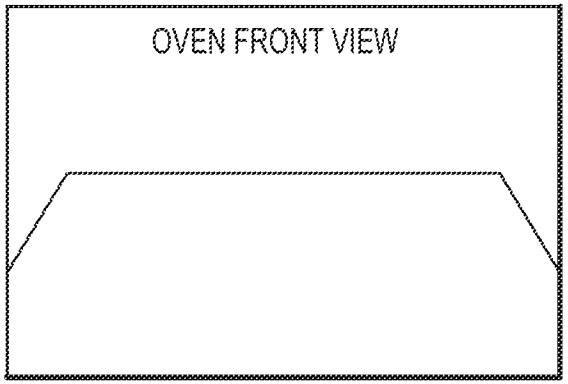
FIG. 2A depicts a front view of a coal bed that was charged into a coke oven using a prior art coal charging system and depicts that the coal bed is not level, having voids at the sides of the bed.
Figure 3A:
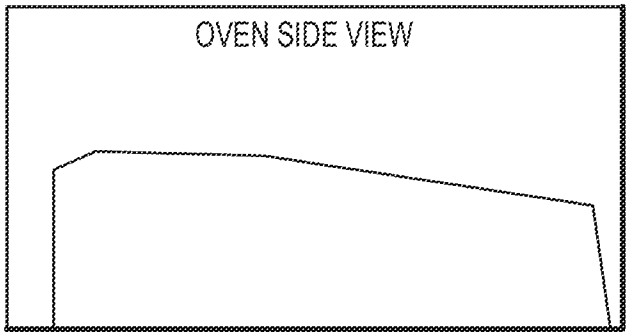
FIG. 3A depicts a side elevation view of a coal bed that was charged into a coke oven using a prior art coal charging system and depicts that the coal bed is not level, having voids at the end portions of the bed.
Figure 3B:
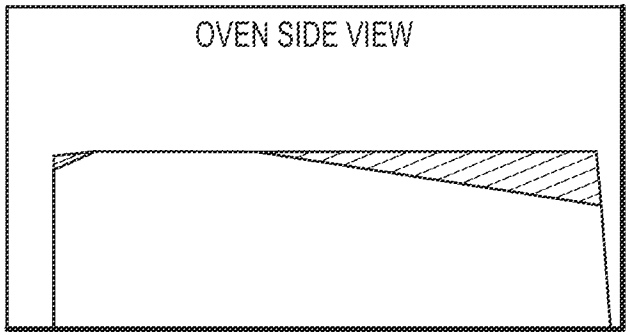
FIG. 3B depicts a side elevation view of a coal bed that was ideally charged into a coke oven, without voids at the end portions of the bed.
Figure 4A:
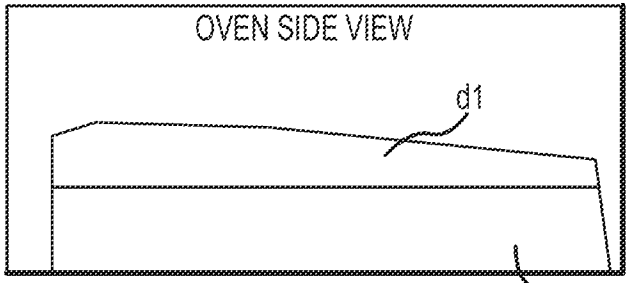
FIG. 4A depicts a side elevation view of a coal bed that was charged into a coke oven using a prior art coal charging system and depicts two different layers of minimal coal density formed by the prior art coal charging system.
Figure 4B:
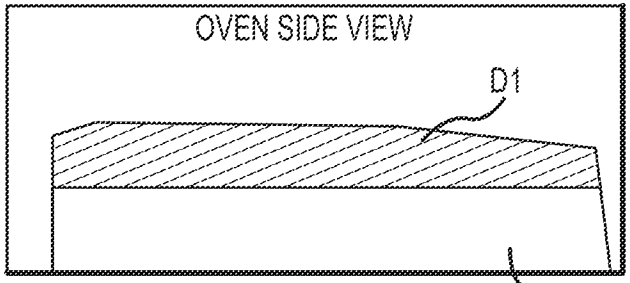
FIG. 4B depicts a side elevation view of a coal bed that was ideally charged into a coke oven having two different layers of relatively increased coal density.

In some embodiments, such as depicted in FIGS. 9A-9C, the opposing wings 128 and 130 include first faces 136 and 138 that extend outwardly from the charging head plane. In particular embodiments, the first faces 136 and 138 extend outwardly from the charging plane at a forty-five degree angle. The angle at which the first face deviates from the charging head plane may be increased or decreased according to the particular intended use of the coal charging system 100. For example, particular embodiments may employ an angle of ten degrees to sixty degrees, depending on the conditions anticipated during charging and leveling operations. In some embodiments, the opposing wings 128 and 130 further include second faces 140 and 142 that extend outwardly from the first faces 136 and 138 toward the free distal end portions 132 and 134. In particular embodiments, the second faces 140 and 142 of the opposing wings 128 and 130 reside within a wing plane that is parallel to the charging head plane. In some embodiments, the second faces 140 and 142 are provided to be approximately ten inches in length. In other embodiments, however, the second faces 140 and 142 may have lengths ranging from zero to ten inches, depending on one or more design considerations, including the length selected for the first faces 136 and 138 and the angles at which the first faces 136 and 138 extend away from the charging plane. As depicted in FIGS. 9A-9C, the opposing wings 128 and 130 are shaped to receive loose coal from the rearward face of the charging head 104, while the coal charging system 100 is being withdrawn across the coal bed being charged, and funnel or otherwise direct loose coal toward the side edges of the coal bed. In at least this manner, the coal charging system 100 may reduce the likelihood of voids at the sides of the coal bed, as shown in FIG. 2A. Rather, the wings 128 and 130 help to promote the level coal bed depicted in FIG. 2B. Testing has shown that use of the opposing wings 128 and 130 can increase the charge weight by one to two tons by filling these side voids. Moreover, the shape of the wings 128 and 130 reduce drag back of the coal and spillage from the pusher side of the oven, which reduces waste and the expenditure of labor to retrieve the spilled coal.

Figure 10A:
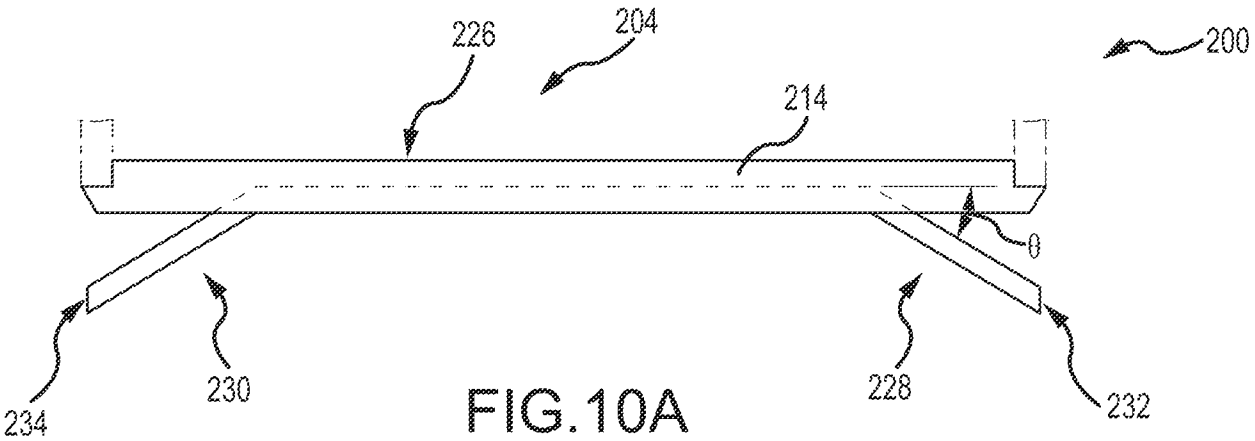
FIG. 10A depicts a top plan view of another embodiment of a charging head according to the present technology.
Figure 10B:
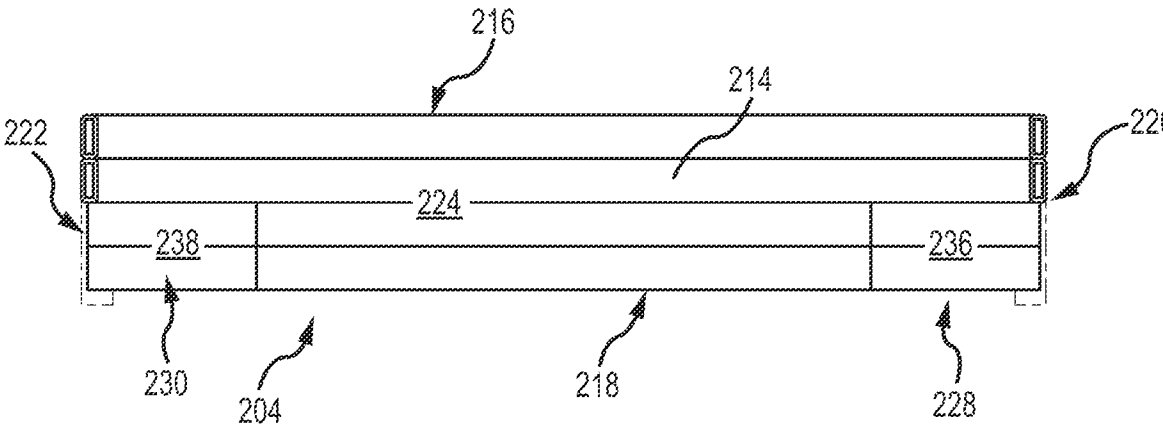
FIG. 10B depicts a front elevation view of the charging head depicted in FIG. 10A.
Figure 10C:
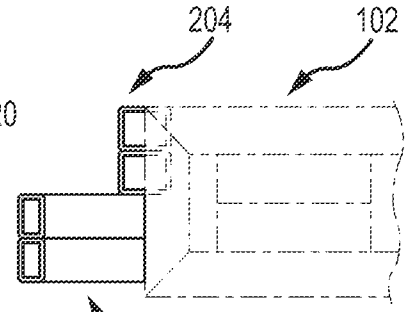
FIG. 10C depicts a side elevation view of the charging head depicted in FIG. 10A.

With reference to FIGS. 10A-10C, another embodiment of a charging head 204 is depicted as having a planar body 214, having an upper edge portion 216, lower edge portion 218, opposite side portions 220 and 222, a front face 224, and a rearward face 226. The charging head 204 further includes a pair of opposing wings 228 and 230 that are shaped to have free end portions 232 and 234 that are positioned in a spaced-apart relationship, forwardly from the charging head plane. In particular embodiments, the free end portions 232 and 234 are spaced forwardly from the charging head plane a distance of six inches to 24 inches. The opposing wings 228 and 230 define open spaces rearwardly from the opposing wings 228 and 230, through the charging head plane. In some embodiments, the opposing wings 228 and 230 include first faces 236 and 238 that extend outwardly from the charging head plane at a forty-five degree angle. In particular embodiments, the angle at which the first faces 236 and 238 deviate from the charging head plane from ten degrees to sixty degrees, depending on the conditions anticipated during charging and leveling operations. The opposing wings 228 and 230 are shaped to receive loose coal from the rearward face of the charging head 204, while the coal charging system is being withdrawn across the coal bed being charged, and funnel or otherwise direct loose coal toward the side edges of the coal bed.

With reference to FIGS. 11A-11C, a further embodiment of a charging head 304 is depicted as having a planar body 314, having an upper edge portion 316, lower edge portion 318, opposite side portions 320 and 322, a front face 324, and a rearward face 326. The charging head 300 further includes a pair of curved opposing wings 328 and 330 that have free end portions 332 and 334 that are positioned in a spaced-apart relationship, forwardly from the charging head plane. In particular embodiments, the free end portions 332 and 334 are spaced forwardly from the charging head plane a distance of six inches to twenty-four inches. The curved opposing wings 328 and 330 define open spaces rearwardly from the curved opposing wings 328 and 330, through the charging head plane. In some embodiments, the curved opposing wings 328 and 330 include first faces 336 and 338 that extend outwardly from the charging head plane at a forty-five degree angle from a proximal end portion of the curved opposing wings 328 and 330. In particular embodiments, the angle at which the first faces 336 and 338 deviate from the charging head plane from ten degrees to sixty degrees. This angle dynamically changes along lengths of the curved opposing wings 328 and 330. The opposing wings 328 and 330 receive loose coal from the rearward face of the charging head 304, while the coal charging system is being withdrawn across the coal bed being charged, and funnel or otherwise direct loose coal toward the side edges of the coal bed.

Figure 12A:
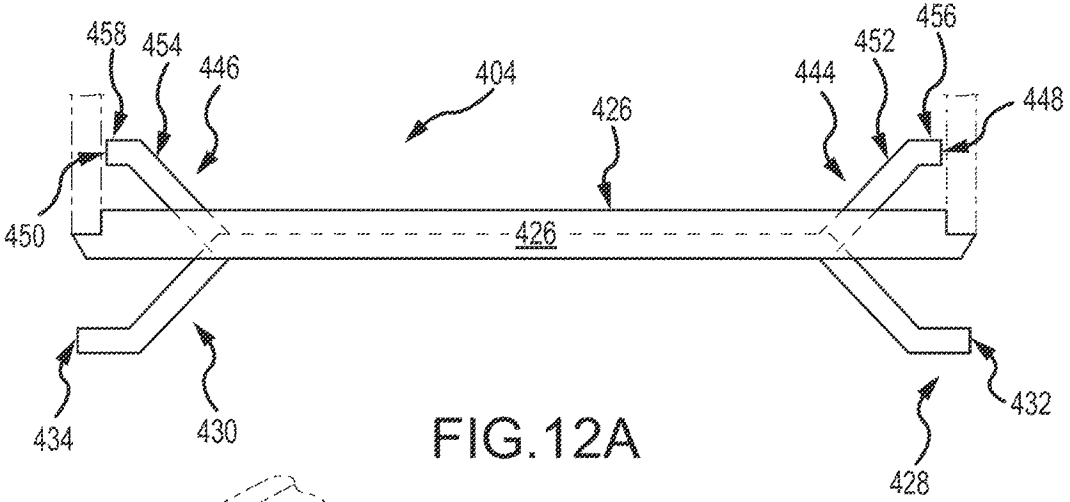
FIG. 12A depicts a top plan view of still another embodiment of a charging head according to the present technology.
Figure 12B:
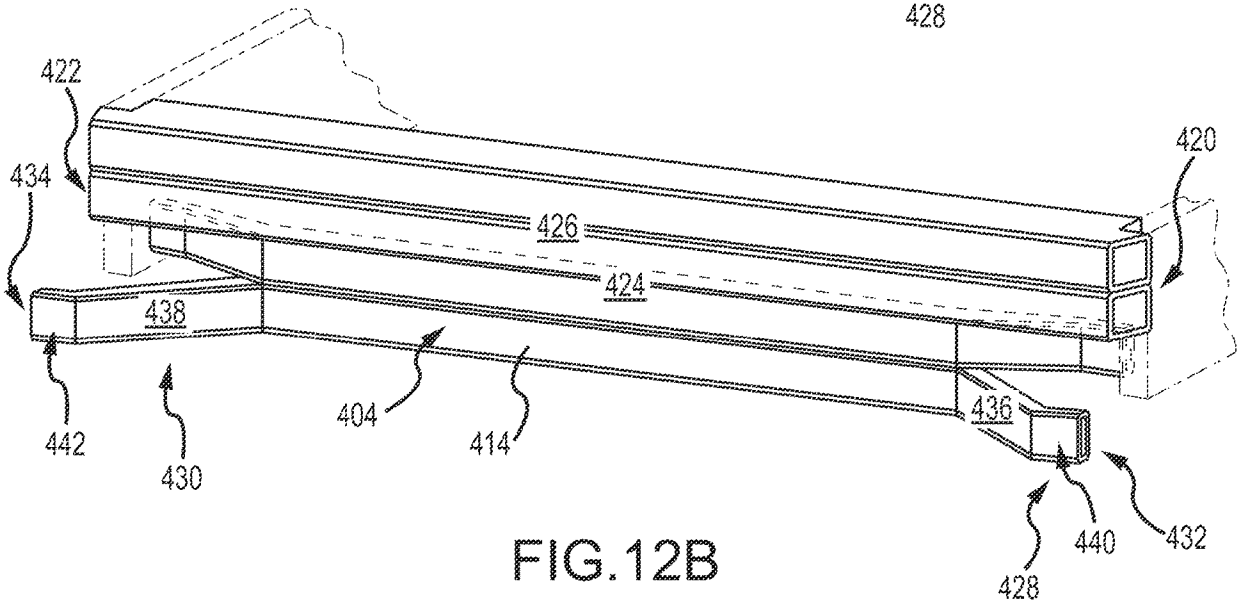
FIG. 12B depicts a front elevation view of the charging head depicted in FIG. 12A.
Figure 12C:
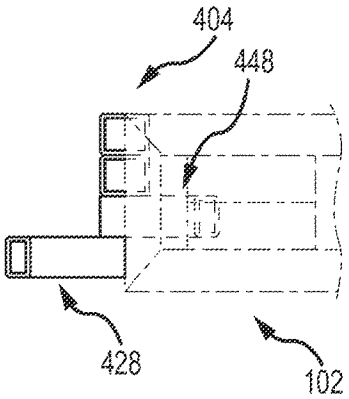
FIG. 12C depicts a side elevation view of the charging head depicted in FIG. 12A.

With reference to FIGS. 12A-12C, an embodiment of a charging head 404 includes a planar body 414, having an upper edge portion 416, lower edge portion 418, opposite side portions 420 and 422, a front face 424, and a rearward face 426. The charging head 400 further includes a first pair of opposing wings 428 and 430 that have free end portions 432 and 434 that are positioned in a spaced-apart relationship, forwardly from the charging head plane. The opposing wings 428 and 430 include first faces 436 and 438 that extend outwardly from the charging head plane. In some embodiments, the first faces 436 and 438 extend outwardly from the charging head plane at a forty-five degree angle. The angle at which the first face deviates from the charging head plane may be increased or decreased according to the particular intended use of the coal charging system 400. For example, particular embodiments may employ an angle of ten degrees to sixty degrees, depending on the conditions anticipated during charging and leveling operations. In some embodiments, the free end portions 432 and 434 are spaced forwardly from the charging head plane a distance of six inches to twenty-four inches. The opposing wings 428 and 430 define open spaces rearwardly from the curved opposing wings 428 and 430, through the charging head plane. In some embodiments, the opposing wings 428 and 430 further include second faces 440 and 442 that extend outwardly from the first faces 436 and 438 toward the free distal end portions 432 and 434. In particular embodiments, the second faces 440 and 442 of the opposing wings 428 and 430 reside within a wing plane that is parallel to the charging head plane. In some embodiments, the second faces 440 and 442 are provided to be approximately ten inches in length. In other embodiments, however, the second faces 440 and 442 may have lengths ranging from zero to ten inches, depending on one or more design considerations, including the length selected for the first faces 436 and 438 and the angles at which the first faces 436 and 438 extend away from the charging plane. The opposing wings 428 and 430 are shaped to receive loose coal from the rearward face of the charging head 404, while the coal charging system 400 is being withdrawn across the coal bed being charged, and funnel or otherwise direct loose coal toward the side edges of the coal bed.

In various embodiments, it is contemplated that opposing wings of various geometries may extend rearwardly from a charging head associated with a coal charging system according to the present technology. With continued reference to FIGS. 12A-12C, the charging head 400 further includes a second pair of opposing wings 444 and 446 that each include free end portions 448 and 450 that are positioned in a spaced-apart relationship, rearwardly from the charging head plane. The opposing wings 444 and 446 include first faces 452 and 454 that extend outwardly from the charging head plane. In some embodiments, the first faces 452 and 454 extend outwardly from the charging head plane at a forty-five degree angle. The angle at which the first faces 452 and 454 deviate from the charging head plane may be increased or decreased according to the particular intended use of the coal charging system 400. For example, particular embodiments may employ an angle of ten degrees to sixty degrees, depending on the conditions anticipated during charging and leveling operations. In some embodiments, the free end portions 448 and 450 are spaced rearwardly from the charging head plane a distance of six inches to twenty-four inches. The opposing wings 444 and 446 define open spaces rearwardly from the opposing wings 444 and 446, through the charging head plane. In some embodiments, the opposing wings 444 and 446 further include second faces 456 and 458 that extend outwardly from the first faces 452 and 454 toward the free distal end portions 448 and 450. In particular embodiments, the second faces 456 and 458 of the opposing wings 444 and 446 reside within a wing plane that is parallel to the charging head plane. In some embodiments, the second faces 456 and 458 are provided to be approximately ten inches in length. In other embodiments, however, the second faces 456 and 458 may have lengths ranging from zero to ten inches, depending on one or more design considerations, including the length selected for the first faces 452 and 454 and the angles at which the first faces 452 and 454 extend away from the charging plane. The opposing wings 444 and 446 are shaped to receive loose coal from the front face 424 of the charging head 404, while the coal charging system 400 is being extended along the coal bed being charged, and funnel or otherwise direct loose coal toward the side edges of the coal bed.

With continued reference to FIGS. 12A-12C, the rearwardly faced opposing wings 444 and 446 are depicted as being positioned above the forwardly faced opposing wings 428 and 430. However, it is contemplated that this particular arrangement may be reversed, in some embodiments, without departing from the scope of the present technology. Similarly, the rearwardly faced opposing wings 444 and 446 and forwardly faced opposing wings 428 and 430 are each depicted as angularly disposed wings having first and second sets of faces that are disposed at angles with respect to one another. However, it is contemplated that either or both sets of opposing wings may be provided in different geometries, such as demonstrated by the straight, angularly disposed opposing wings 228 and 230, or the curved wings 328 and 330. Other combinations of known shapes, intermixed or in pairs, are contemplated. Moreover, it is further contemplated that the charging heads of the present technology could be provided with one or more sets of opposing wings that only face rearwardly from the charging head, with no wings that face forwardly. In such instances, the rearwardly positioned opposing wings will distribute the coal to the side portions of the coal bed when the coal charging system is moving forward (charging).

Figure 13:
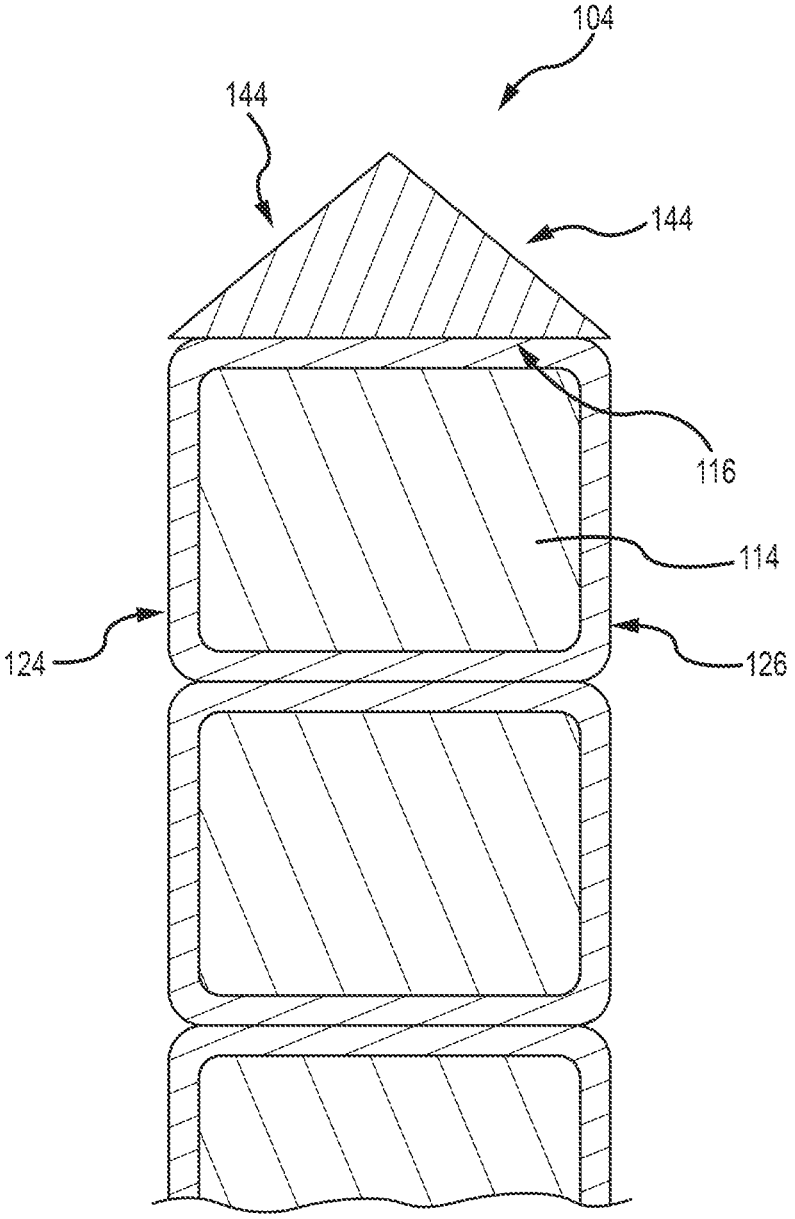
FIG. 13 depicts a side elevation view of one embodiment of a charging head, according to the present technology, wherein the charging head includes particulate deflection surfaces on top of the upper edge portion of the charging head.

With reference to FIG. 13, it is contemplated that, as the coal is being charged into the oven and as the coal charging system 100 (or in a similar manner charging heads 526, 300, or 400) is being withdrawn across the coal bed, loose coal may begin to pile onto the upper edge portion 116 of the charging head 104. Accordingly, some embodiments of the present technology will include one or more angularly disposed particulate deflection surfaces 144 on top of the upper edge portion 116 of the charging head 104. In the depicted example, a pair of oppositely faced particulate deflection surfaces 144 combine to form a peaked structure, which disperses errant particulate material in front of and behind the charging head 104. It is contemplated that it may be desirable in particular instances to have the particulate material land primarily in front of or behind the charging head 104, but not both. Accordingly, in such instances, a single particulate deflection surface 144 may be provided with an orientation chosen to disperse the coal accordingly. It is further contemplated that the particulate deflection surfaces 144 may be provided in other, non-planar or non-angular configurations. In particular, the particulate deflection surfaces 144 may be flat, curvilinear, convex, concave, compound, or various combinations thereof. Some embodiments will merely dispose the particulate deflection surfaces 144 so that they are not horizontally disposed. In some embodiments, the particulate surfaces can be integrally formed with the upper edge portion 116 of the charging head 104, which may further include a water cooling feature.

Figure 14:
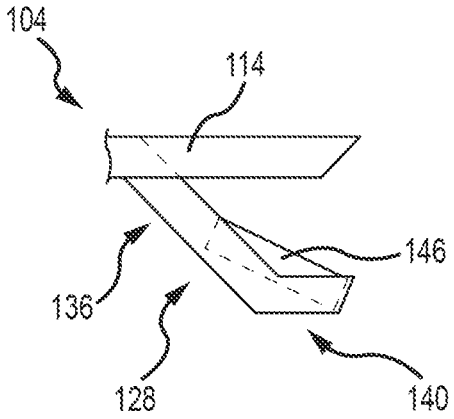
FIG. 14 depicts a partial, top elevation view of one embodiment of the charging head of the present technology and further depicts one embodiment of a densification bar and one manner in which it can be coupled with a wing of the charging head.
Figure 15:
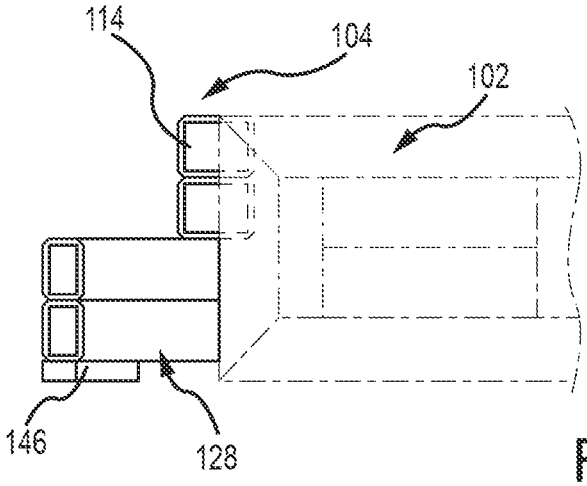
FIG. 15 depicts a side elevation view of the charging head and densification bar depicted in FIG. 14.
Figure 16:
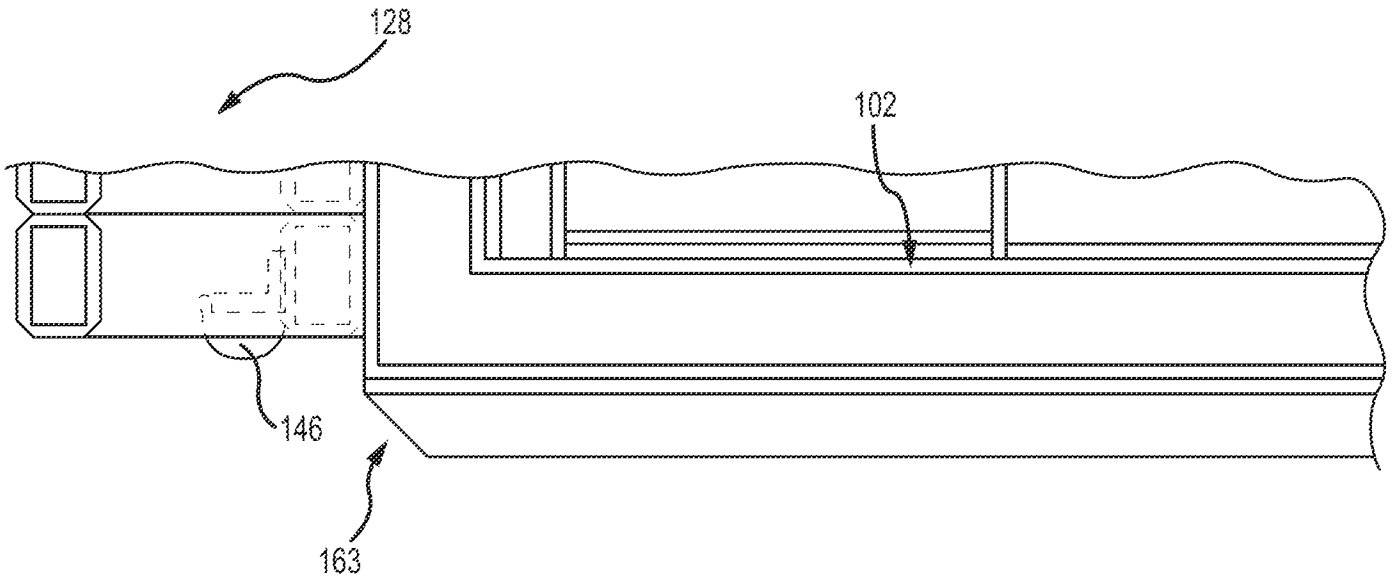
FIG. 16 depicts a partial side elevation view of one embodiment of the charging head of the present technology and further depicts another embodiment of a densification bar and a manner in which it can be coupled with the charging head.

Coal bed bulk density plays a significant role in determining coke quality and minimizing burn loss, particularly near the oven walls. During a coal charging operation, the charging head 104 retracts against a top portion of the coal bed. In this manner, the charging head contributes to the top shape of the coal bed. However, particular aspects of the present technology cause portions of the charging head to increase the density of the coal bed. With regard to FIGS. 13 and 14, the opposing wings 128 and 130 may be provided with one or more elongated densification bars 146 that, in some embodiments, extend along a length of, and downwardly from, each of the opposing wings 128 and 130. In some embodiments, such as depicted in FIGS. 13 and 14, the densification bars 146 may extend downwardly from bottom surfaces of the opposing wings 128 and 130. In other embodiments, the densification bars 146 may be operatively coupled with forward or rearward faces of either or both of the opposing wings 128 and 130 and/or the lower edge portion 118 of the charging head 104. In particular embodiments, such as depicted in FIG. 13, the elongated densification bar 146 has a long axis disposed at an angle with respect to the charging head plane. It is contemplated that the densification bar 146 may be formed from a roller that rotates about a generally horizontal axis, or a static structure of various shapes, such as a pipe or rod, formed from a high temperature material. The exterior shape of the elongated densification bar 146 may be planar or curvilinear. Moreover, the elongated densification bar may be curved along its length or angularly disposed.

Figure 17:
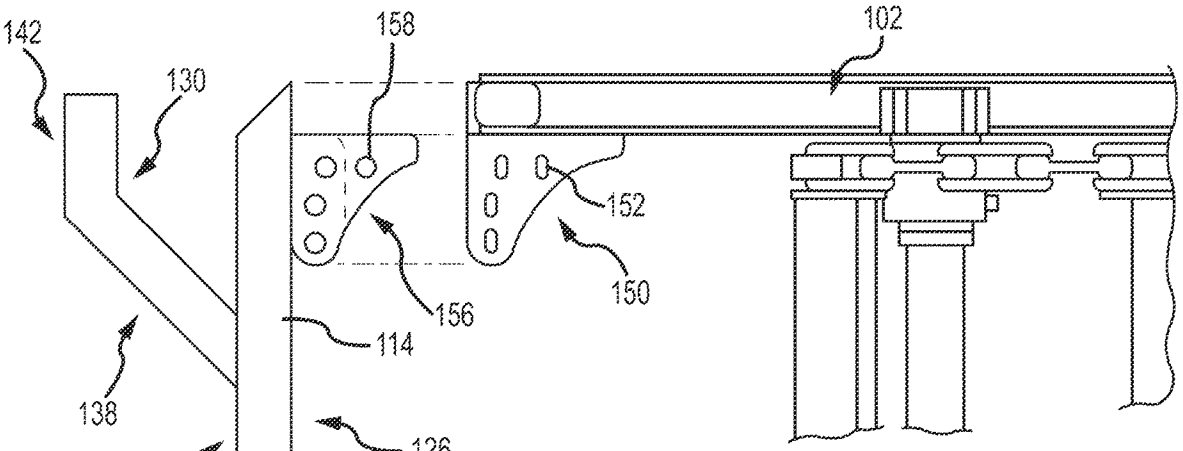
FIG. 17 depicts a partial, top elevation view of one embodiment of a charging head and charging frame, according to the present technology, and further depicts one embodiment of a slotted joint that couples the charging head and charging frame with one another.
Figure 18:
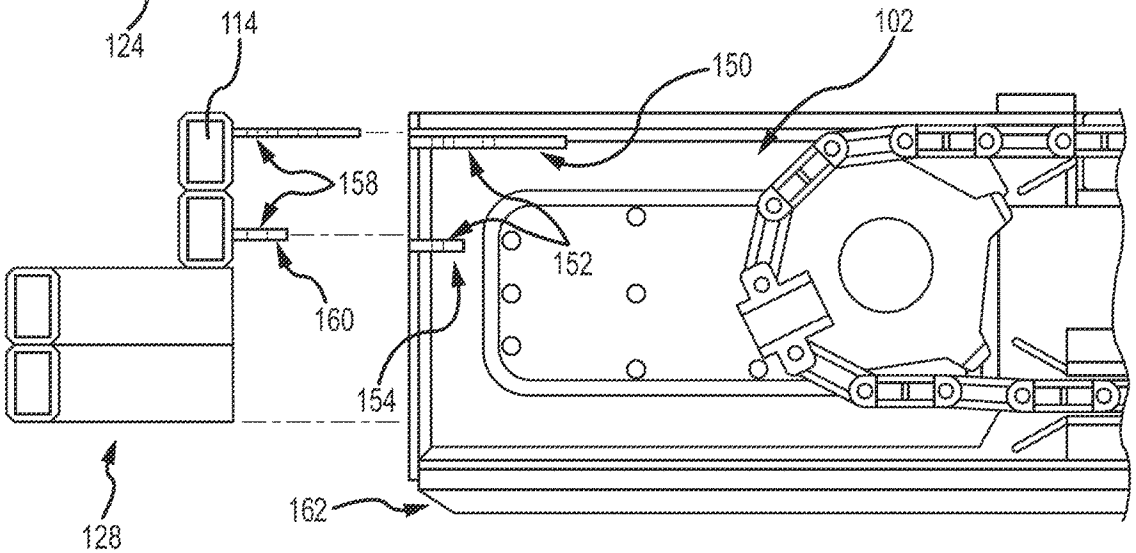
FIG. 18 depicts a partial, cutaway side elevation view of the charging head and charging frame depicted in FIG. 17.

In some embodiments, the charging heads and charging frames of various systems may not include a cooling system. The extreme temperatures of the ovens will cause portions of such charging heads and charging frames to expand slightly, and at different rates, with respect to one another. In such embodiments, the rapid, uneven heating and expansion of the components may stress the coal charging system and warp or otherwise misalign the charging head with respect to the charging frame. With reference to FIGS. 17 and 18, embodiments of the present technology couple the charging head 104 to the sides 106 and 108 of the charging frame 102 using a plurality of slotted joints that allow relative movement between the charging head 104 and the elongated charging frame 102. In at least one embodiment, first frame plates 150 extend outwardly from inner faces of the sides 106 and 108 of the elongated frame 102. The first frame plates 150 include one or more elongated mounting slots 152 that penetrate the first frame plates 150. In some embodiments, second frame plates 154 are also provided to extend outwardly from the inner faces of the sides 106 and 108, beneath the first frame plates 150. The second frame plates 154 of the elongated frame 102 also include one or more elongated mounting slots 152 that penetrate the second frame plates 154. First head plates 156 extend outwardly from opposite sides of the rearward face 126 of the charging head 104. The first head plates 156 include one or more mounting apertures 158 that penetrate the first head plates 156. In some embodiments, second head plates 160 are also provided to extend outwardly from the rearward face 126 of the charging head 104, beneath the first head plates 156. The second head plates 160 also include one or more mounting apertures 158 that penetrate the second head plates 158. The charging head 104 is aligned with the charging frame 102 so that the first frame plates 150 align with first head pates 156 and the second frame plates 154 align with the second head plates 160. Mechanical fasteners 161 pass through the elongated mounting slots 152 of the first frame plates 150 and second frame plates 152 and corresponding mounting apertures 160. In this manner, the mechanical fasteners 161 are placed in a fixed position with respect to the mounting apertures 160 but are allowed to move along lengths of the elongated mounting slots 152 as the charging head 104 move with respect to the charging frame 102. Depending on the size and configuration of the charging head 104 and the elongated charging frame 102, it is contemplated that more or fewer charging head plates and frame plates of various shapes and sizes could be employed to operatively couple the charging head 104 and the elongated charging frame 102 with one another.

Figure 20:
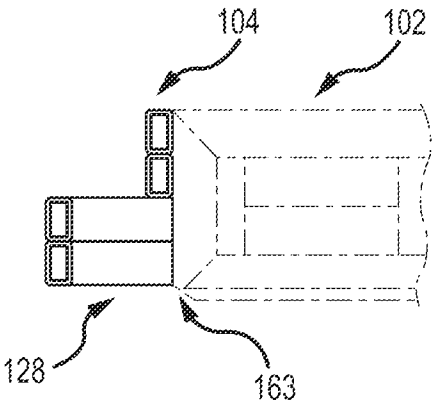
FIG. 20 depicts a partial, cutaway side elevation view of the charging head and charging frame depicted in FIG. 19.
Figure 19:
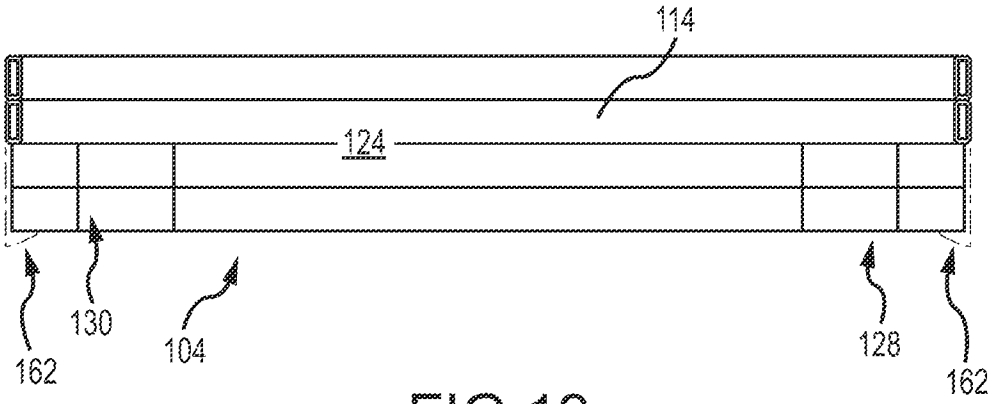
FIG. 19 depicts a partial front elevation view of one embodiment of a charging head and charging frame, according to the present technology, and further depicts one embodiment of a charging frame deflection face that may be associated with the charging frame.
Figure 21:
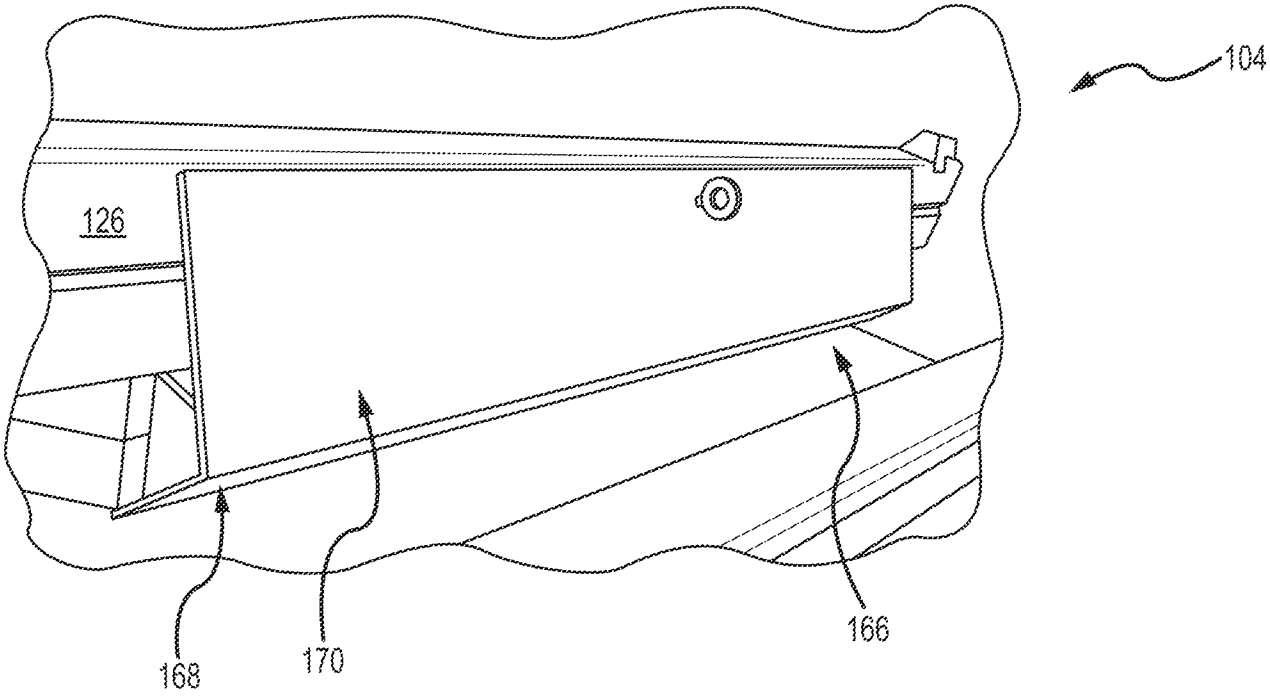
FIG. 21 depicts a front perspective view of one embodiment of an extrusion plate, according to the present technology, and further depicts one manner in which it may be associated with a rearward face of a charging head.
Figure 22:
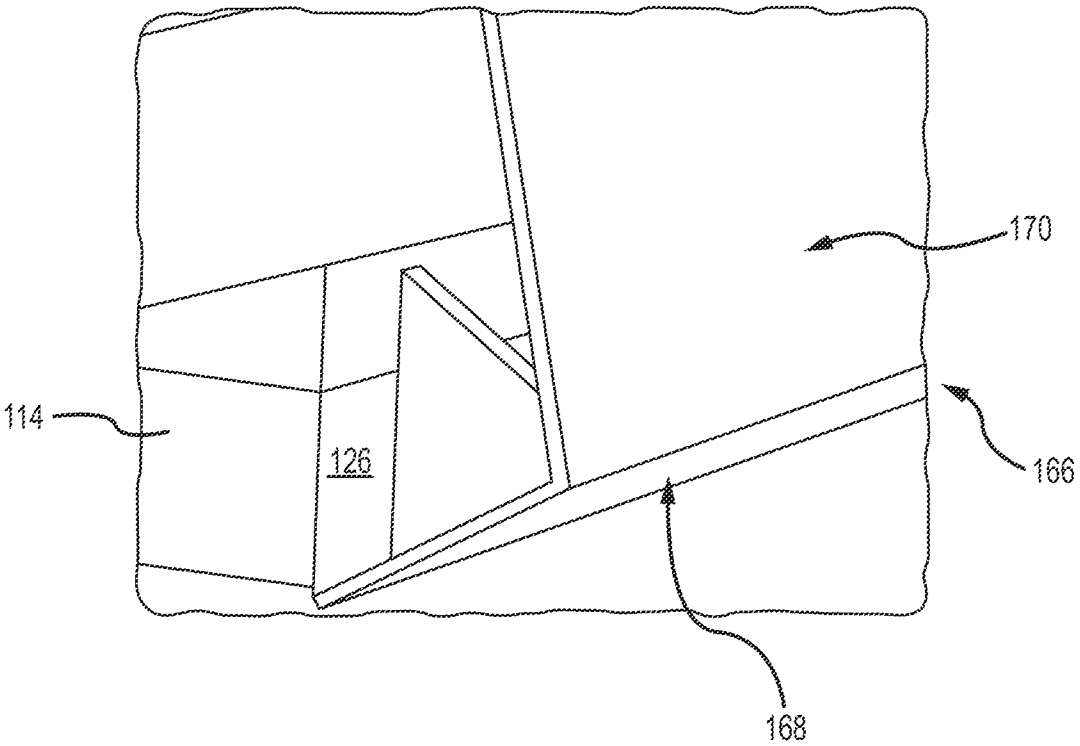
FIG. 22 depicts a partial isometric view of the extrusion plate and charging head depicted in FIG. 21.

With reference to FIGS. 19 and 20, particular embodiments of the present technology provide the lower inner faces of each of the opposite sides 106 and 108 of the elongated charging frame 102 with charging frame deflection faces 162, positioned to face at a slightly downward angle toward a middle portion of the charging frame 102. In this manner, the charging frame deflection faces 162 engage the loosely charged coal and direct the coal down and toward the sides of the coal bed being charged. The angle of the deflection faces 162 further compress the coal downwardly in a manner that helps to increase the density of the edge portions of the coal bed. In another embodiment, forward end portions of each of the opposite sides 106 and 108 of the elongated charging frame 102 include charging frame deflection faces 163 that are also positioned rearwardly from the wings but are oriented to face forwardly and downwardly from the charging frame. In this manner, the deflection faces 163 may further help to increase the density of the coal bed and direct the coal outwardly toward the edge portions of the coal bed in an effort to more fully level the coal bed.

Figure 6:
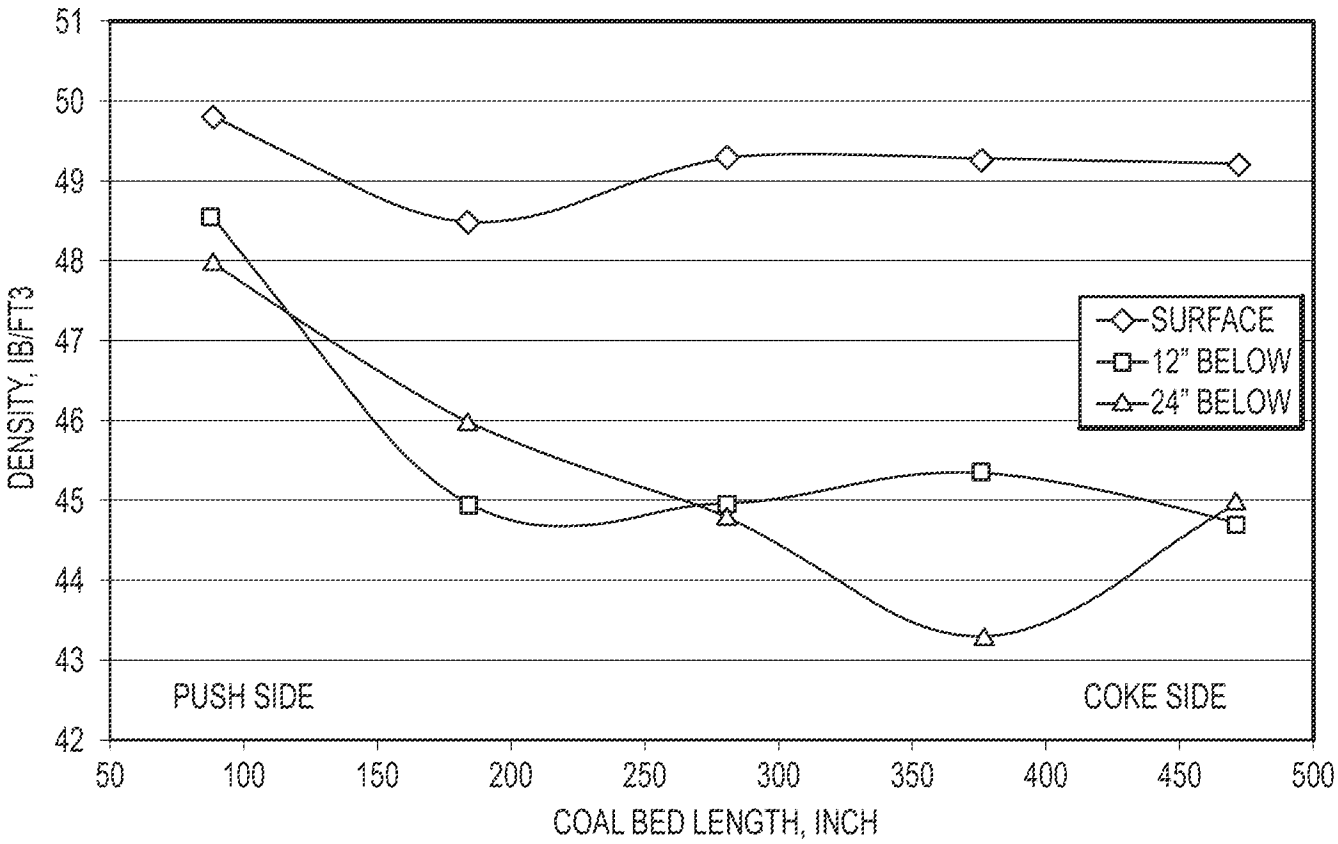
FIG. 6 depicts a plot of test data of bed height over bed length and the bed height drop, due to coal charging system deflection.
Figure 7:
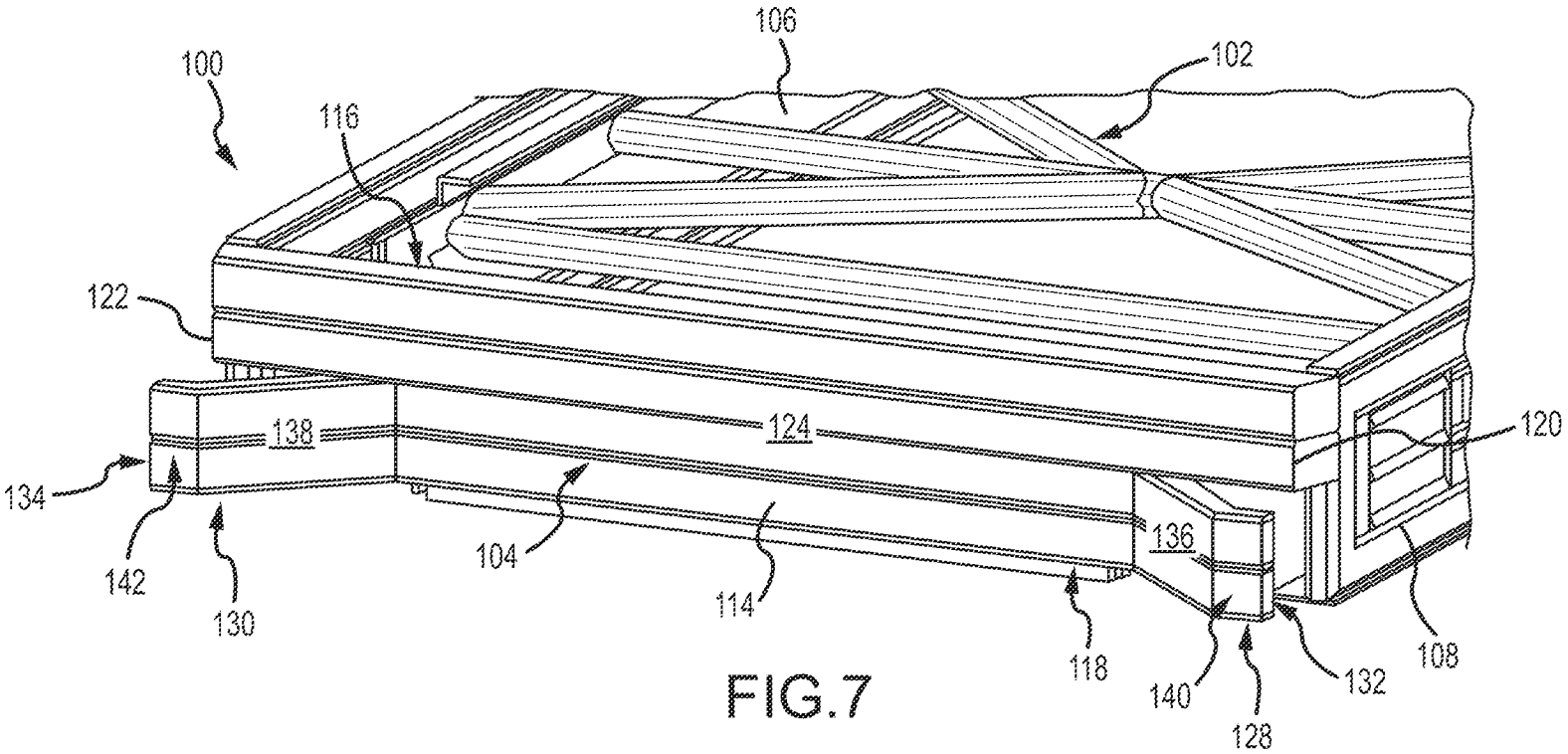
FIG. 7 depicts a front, perspective view of one embodiment of a charging frame and charging head of a coal charging system according to the present technology.
Figure 8:
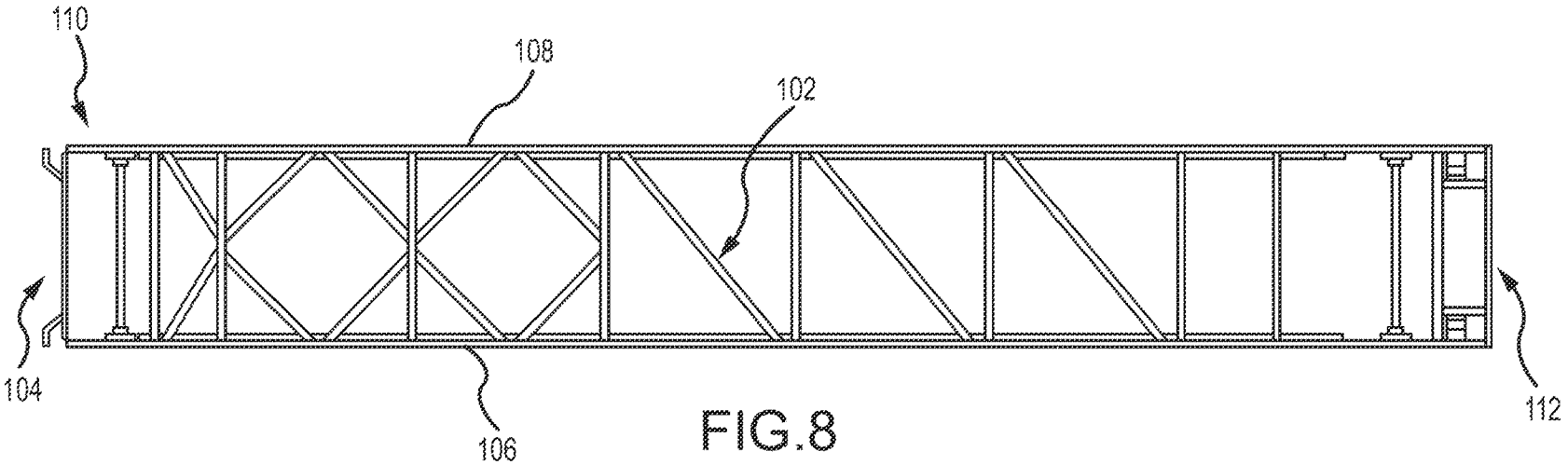
FIG. 8 depicts a top, plan view of the charging frame and charging head depicted in FIG. 7.

Many prior coal charging systems provide a minor amount of compaction on the coal bed surface due to the weight of the charging head and charging frame. However, the compaction is typically limited to twelve inches below the surface of the coal bed. Data during coal bed testing demonstrated that the bulk density measurement in this region to be a three to ten unit point difference inside the coal bed. FIG. 6 graphically depicts density measurements taken during mock oven testing. The top line shows the density of the coal bed surface. The lower two lines depict the density at twelve inches and twenty-four inches below the coal bed surface, respectively. From the testing data, one can conclude that bed density drops more significantly on the coke side of the oven.

With reference to FIGS. 21-28, various embodiments of the present technology position an extrusion plate 166 operatively coupled with the rearward face 126 of the charging head 104. In some embodiments, the extrusion plate 166 includes a coal engagement face 168 that is oriented to face rearwardly and downwardly with respect to the charging head 104. In this manner, loose coal being charged into the oven behind the charging head 104 will engage the coal engagement face 168 of the extrusion plate 166. Due to the pressure of the coal being deposited behind the charging head 104, the coal engagement face 168 compacts the coal downwardly, increasing the coal density of the coal bed beneath the extrusion plate 166. In various embodiments, the extrusion plate 166 extends substantially along a length of the charging head 104 in order to maximize density across a significant width of the coal bed. With continued reference to FIGS. 20 and 21, the extrusion plate 166 further includes an upper deflection face 170 that is oriented to face rearwardly and upwardly with respect to the charging head 104. In this manner, the coal engagement face 168 and the upper deflection face 170 are coupled with one another to define a peak shape, having a peak ridge that faces rearwardly away from the charging head 104. Accordingly, any coal that falls atop the upper deflection face 170 will be directed off the extrusion plate 166 to join the incoming coal before it is extruded.

Figure 23:
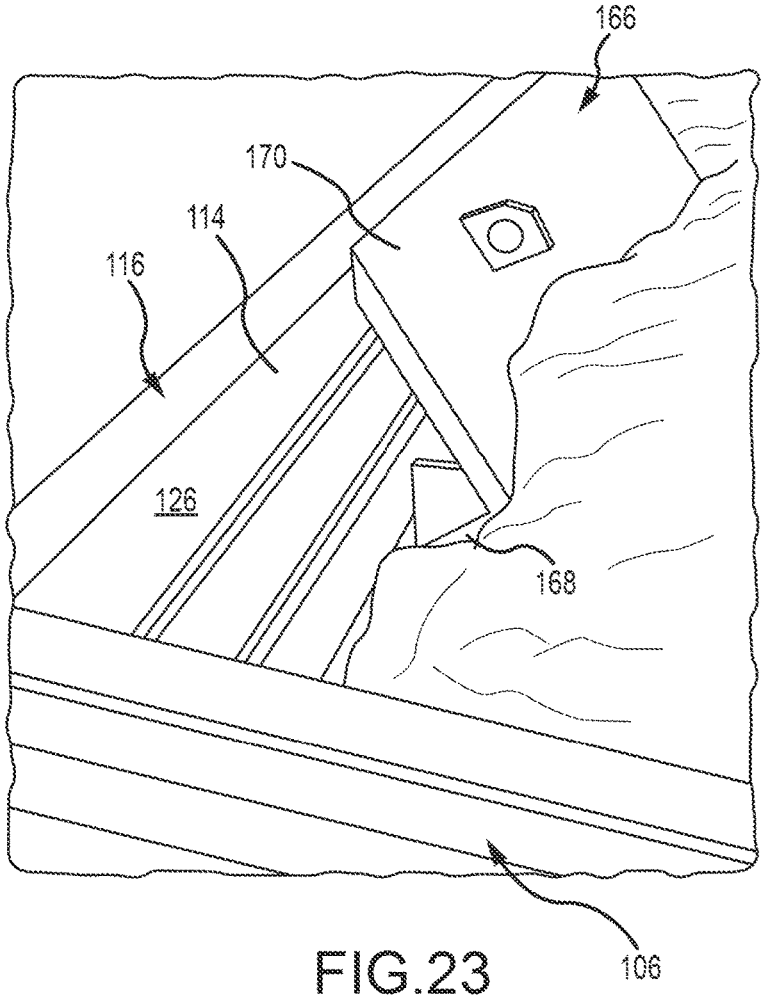
FIG. 23 depicts a side perspective view of one embodiment of an extrusion plate, according to the present technology, and further depicts one manner in which it may be associated with a rearward face of a charging head and extrude coal that is being conveyed into a coal charging system.

In use, coal is shuffled to the front end portion of the coal charging system 100, behind the charging head 104. Coal piles up in the opening between the conveyor and the charging head 104 and conveyor chain pressure starts to build up gradually until reaching approximately 2500 to 2800 psi. With reference to FIG. 23, the coal is fed into the system behind the charging head 104 and the charging head 104 is retracted, rearwardly through the oven. The extrusion plate 166 compacts the coal and extrudes it into the coal bed.

Figure 24A:
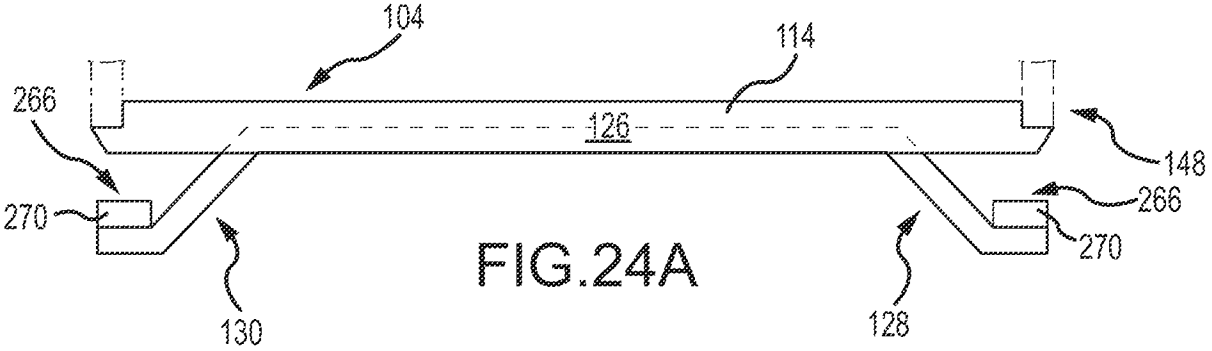
FIG. 24A depicts a top plan view of another embodiment of extrusion plates, according to the present technology, and further depicts one manner in which they may be associated with wing members of a charging head.
Figure 24B:
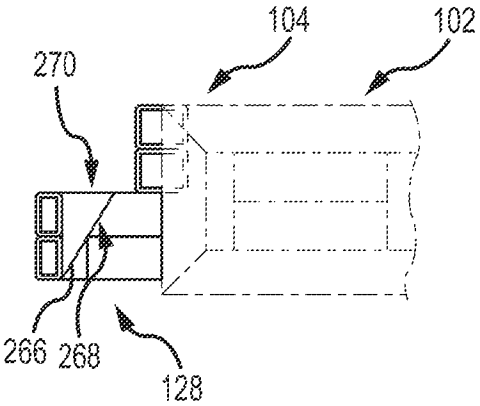
FIG. 24B depicts a side elevation view of the extrusion plates of FIG. 24A.
Figure 25A:
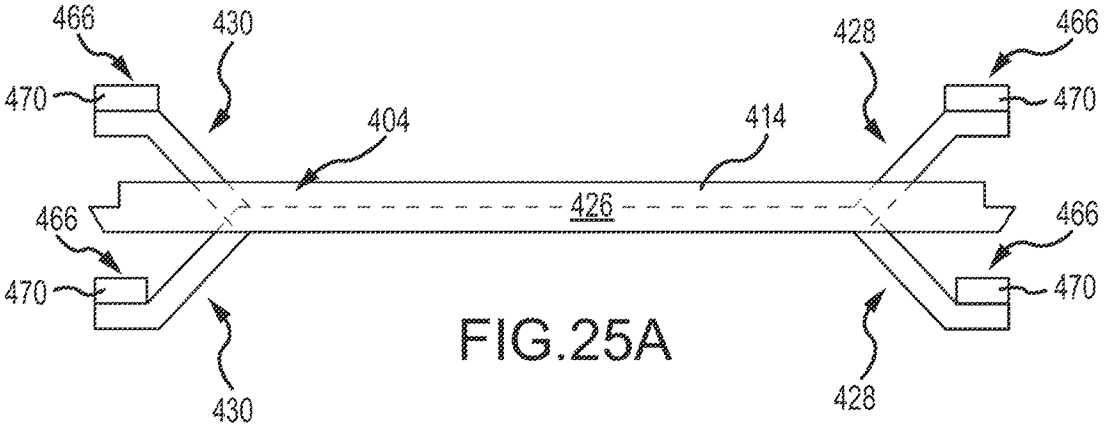
FIG. 25A depicts a top plan view of still another embodiment of extrusion plates, according to the present technology, and further depicts one manner in which they may be associated with multiple sets of wing members that are disposed both forwardly and rearwardly of a charging head.
Figure 25B:
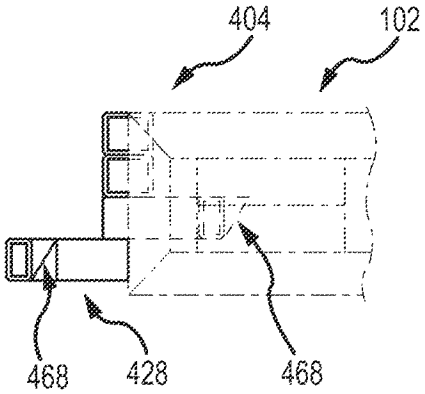
FIG. 25B depicts a side elevation view of the extrusion plates of FIG. 25A.

With reference to FIGS. 24A-25B, embodiments of the present technology may associate extrusion plates with one or more wings that extend from the charging head. FIGS. 24A and 24B depict one such embodiment where extrusion plates 266 extend rearwardly from opposing wings 128 and 130. In such embodiments, the extrusion plates 266 are provided with coal engagement faces 268 and upper deflection faces 270 that are coupled with one another to define a peak shape, having a peak ridge that faces rearwardly away from the opposing wings 128 and 130. The coal engagement faces 268 are positioned to compact the coal downwardly as the coal charging system is retracted through the oven, increasing the coal density of the coal bed beneath the extrusion plates 266. FIGS. 25A and 25B depict a charging head similar to that depicted in FIGS. 12A-12C except that extrusion plates 466, having coal engagement faces 468 and upper deflection faces 470, are positioned to extend rearwardly from the opposing wings 428 and 430. The extrusion plates 466 function similarly to the extrusion plates 266. Additional extrusion plates 466 may be positioned to extend forwardly from the opposing wings 444 and 446, which are positioned behind the charging head 400. Such extrusion plates compact the coal downwardly as the coal charging system is advanced through the oven, further increasing the coal density of the coal bed beneath the extrusion plates 466.

Figure 26:
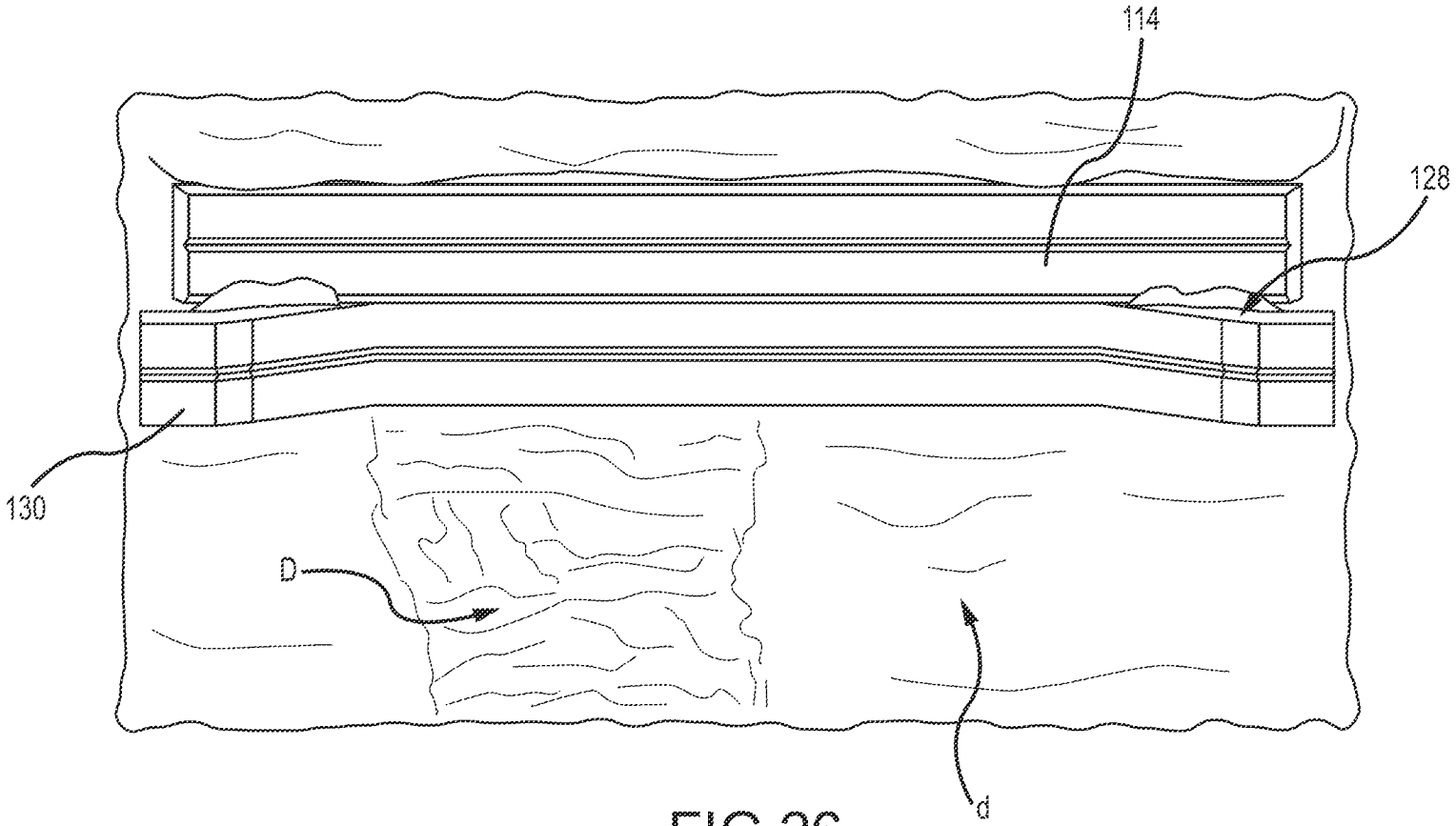
FIG. 26 depicts a front elevation view of one embodiment of a charging head, according to the present technology, and further depicts the differences in coal bed densities when an extrusion plate is used and not used in a coal bed charging operation.
Figure 27:
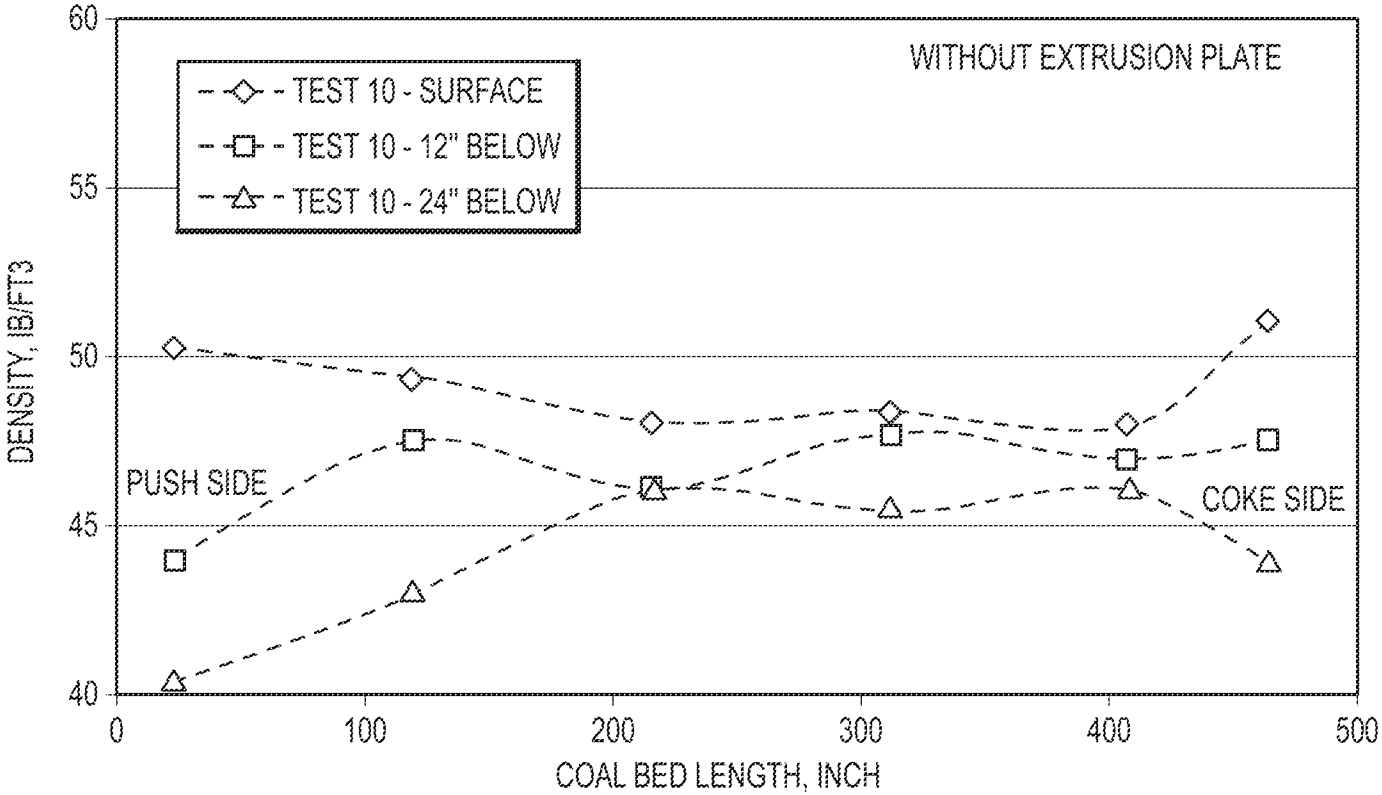
FIG. 27 depicts a plot of coal bed density over a length of a coal bed where the coal bed is charged without the use of an extrusion plate.
Figure 28:
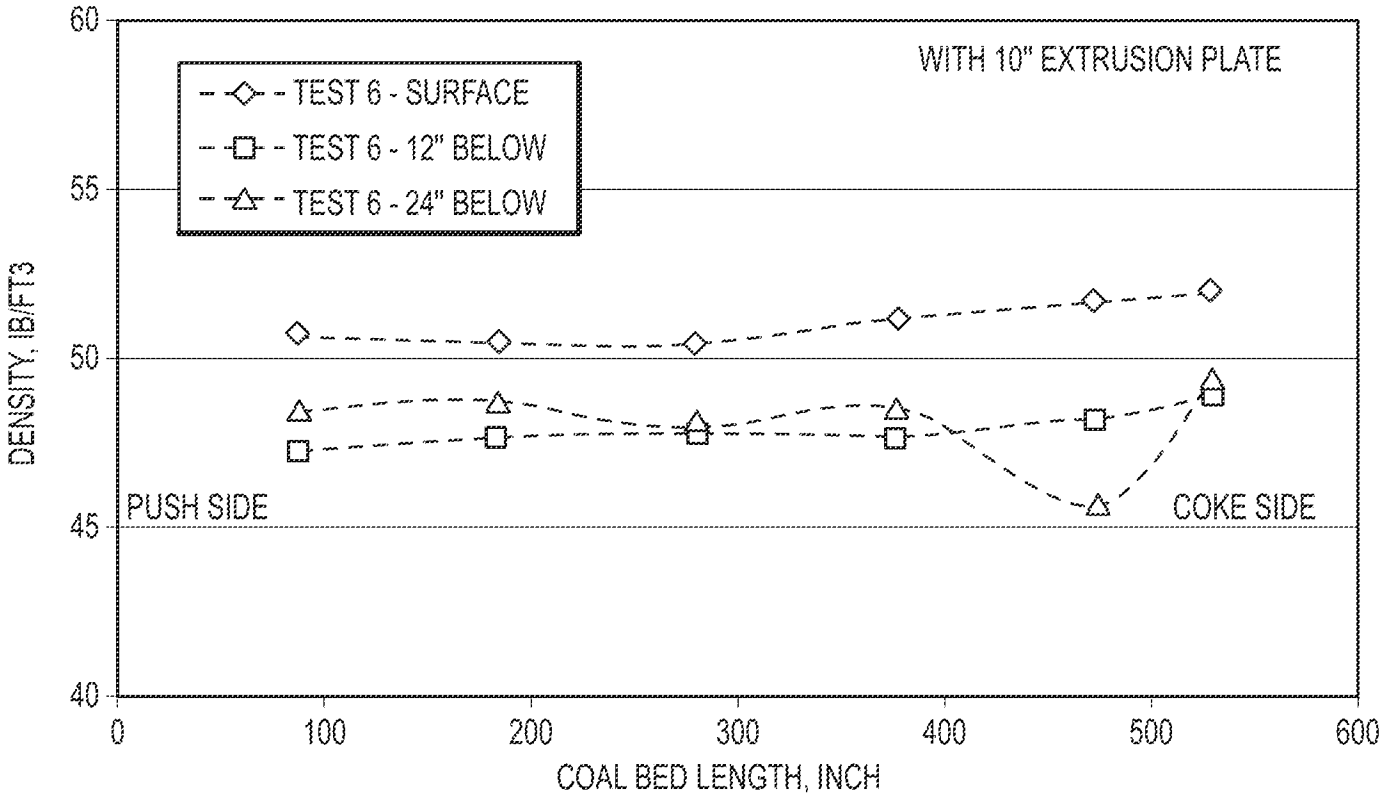
FIG. 28 depicts a plot of coal bed density over a length of a coal bed where the coal bed is charged with the use of an extrusion plate.

FIG. 26 depicts the effect on the density of a coal charge with the benefit of the extrusion plate 166 (left side of the coal bed) and without the benefit of the extrusion plate 166 (right side of the coal bed). As depicted, use of the extrusion plate 166 provides area "D" of increased coal bed bulk density and an area of lesser coal bed bulk density "d" where the extrusion plate is not present. In this manner, the extrusion plate 166 not only demonstrates an improvement in the surface density, but also improves the overall internal bed bulk density. The test results, depicted in FIGS. 27 and 28 below, show the improvement of bed density with the use of the extrusion plate 166 (FIG. 28) and without the use of the extrusion plate 166 (FIG. 27). The data demonstrates a significant impact on both surface density and twenty-four inches below the surface of the coal bed. In some testing, an extrusion plate 166 having a ten inch peak (distance from back of the charging head 104 to the peak ridge of the extrusion plate 166, where the coal engagement face 168 and the upper deflection face 170 meet). In other tests, where a six inch peak was used, coal density was increased but not to the levels resulting from the use of the ten inch peak extrusion plate 166. The data reveals that the use of the ten inch peak extrusion plate increased the density of the coal bed, which allowed for an increase in charge weight of approximately two and a half tons. In some embodiments of the present technology, it is contemplated that smaller extrusion plates, of five to ten inches in peak height, for example, or larger extrusion plates, of ten to twenty inches in peak height, for example, could be used.

Figure 29:
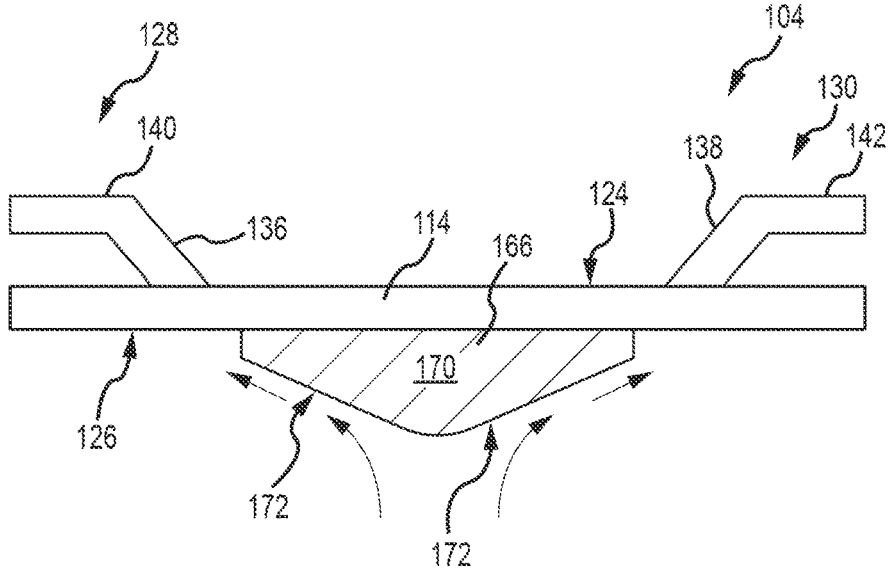
FIG. 29 depicts a top plan view of one embodiment of a charging head, according to the present technology, and further depicts another embodiment of an extrusion plate that may be associated with a rearward surface of the charging head.

With reference to FIG. 29, other embodiments of the present technology provide an extrusion plate 166 that is shaped to include opposing side deflection faces 172 that are oriented to face rearwardly and laterally with respect to the charging head 104. By shaping the extrusion plate 166 to include the opposing side deflection faces 172, testing showed that more extruded coal flowed toward both sides of the bed while it was extruded. In this manner, extrusion plate 166 helps to promote the level coal bed, depicted in FIG. 2B, as well as an increase in coal bed density across the width of the coal bed.

Figure 5:
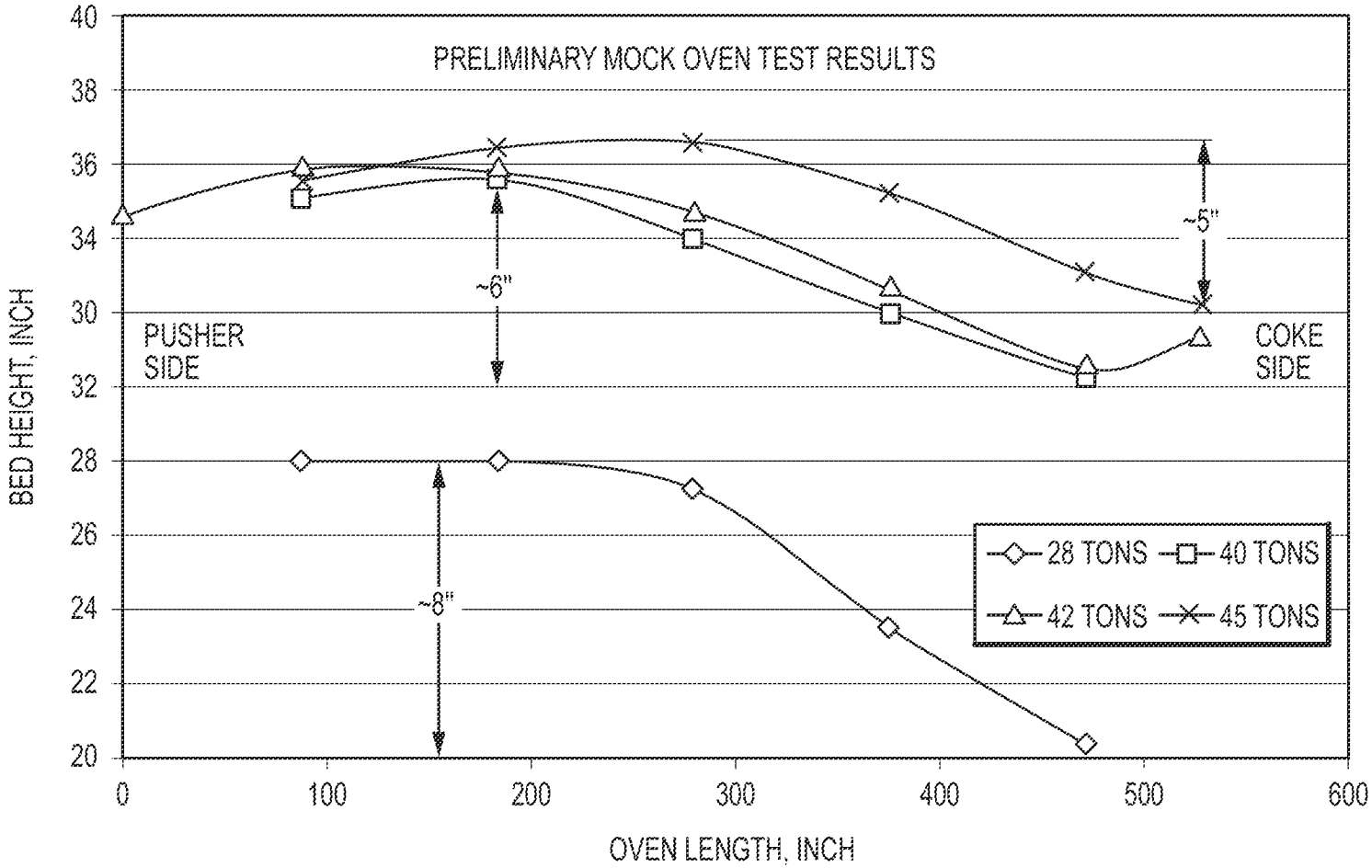
FIG. 5 depicts a plot of mock data of surface and internal coal bulk density over bed length.

When charging systems extend inside the ovens during charging operations, the coal charging systems, typically weighing approximately 80,000 pounds, deflect downwardly at their free, distal ends. This deflection shortens the coal charge capacity. FIG. 5 shows that the bed height drop, due to coal charging system deflection, is from five inches to eight inches between the pusher side to the coke side, depending upon the charge weight. In general, coal charging system deflection can cause a coal volume loss of approximately 1 to 2 tons. During a charging operation, coal piles up in the opening between the conveyor and the charging head 104 and conveyor chain pressure starts to build up. Traditional coal charging systems operate at a chain pressure of approximately 2300 psi. However, the coal charging system of the present technology can be operated at a chain pressure of approximately 2500 to 2800 psi. This increase in chain pressure increases the rigidity of the coal charging system 100 along a length of its charging frame 102. Testing indicates that operating the coal charging system 100 at a chain pressure of approximately 2700 psi reduces deflection of the coal charging system deflection by approximately two inches, which equates to a higher charge weight and increased production. Testing has further shown that operating the coal charging system 100 at a higher chain pressure of approximately 3000 to 3300 psi can produce a more effective charge and further realize greater benefit from the use of one or more extrusion plates 166, as described above.

Figure 30:
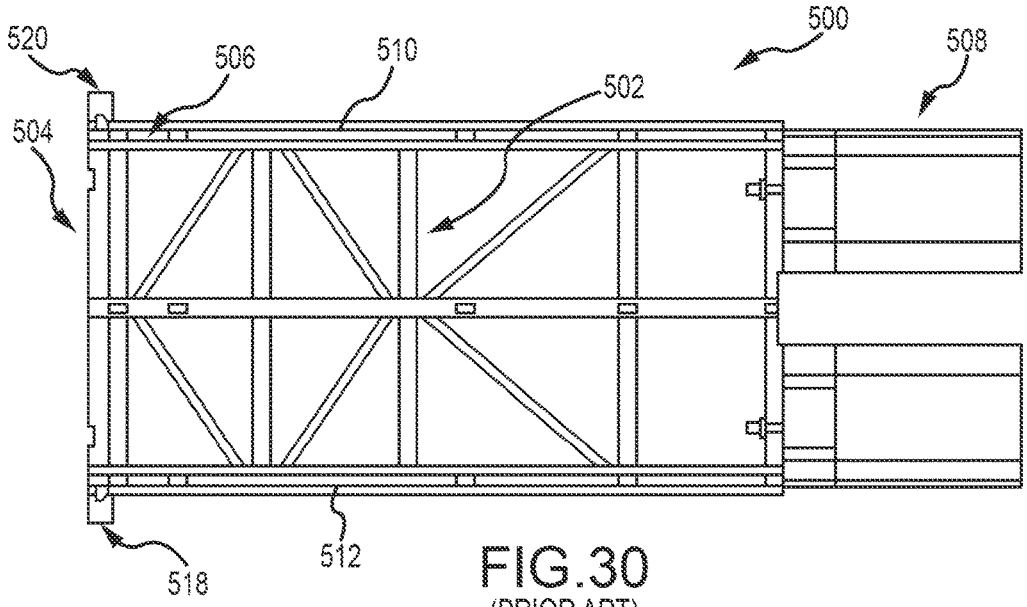
FIG.30 (PRIOR ART)
FIG. 30 depicts a top, plan view of a prior art false door assembly.
Figure 31:
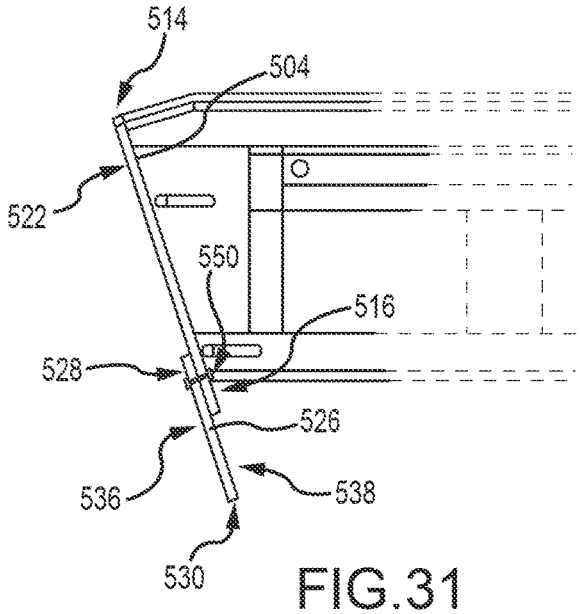
FIG.31 (PRIOR ART)
FIG. 31 depicts a side elevation view of the false door assembly depicted in FIG. 30.

With reference to FIGS. 30 and 31, various embodiments of the coal charging system 100 include a false door assembly 500, having an elongated false door frame 502 and a false door 504, which is coupled to a distal end portion 506 of the false door frame 502. The false door frame 502 further includes a proximal end portion 508, and opposite sides 510 and 512 that extend between the proximal end portion 508 and the distal end portion 506. In various applications, the proximal end portion 508 may be coupled with a PCM in a manner that permits selective extension and retraction of the false door frame 502 into and from within a coke oven interior during a coal charging operation. In some embodiments, the false door frame 502 is coupled with the PCM adjacent to and, in many instances, beneath the charging frame 102. The false door 504 is generally planar, having an upper end portion 514, a lower end portion 516, opposite side portions 518 and 520, a front face 522, and a rearward face 524. In operation, the false door 504 is placed just inside the coke oven during a coal charging operation. In this manner, the false door 504 substantially prevents loose coal from unintentionally exiting the pusher side of the coke oven until the coal is fully charged and the coke oven can be closed. Traditional false door designs are angled so that the lower end portion 516 of the false door 504 is positioned rearwardly of a top end portion 514 of the false door 504. This creates an end portion of a coal bed having a sloped or angled shape that typically terminates twelve inches to thirty-six inches into the coke oven from its pusher side opening.

The false door 504 includes an extension plate 526, having an upper end portion 528, a lower end portion 530, opposite side portions 530 and 534, a front face 536, and a rearward face 538. The upper end portion 528 of extension plate 526 is removably coupled to the lower end portion 516 of the false door 504 so that the lower end portion 530 of the extension plate 526 extends lower than the lower end portion 516 of the false door 504. In this manner a height of the front face 522 of the false door 504 may be selectively increased to accommodate the charging of a coal bed having a greater height. The extension plate 526 is typically coupled with the false door 504 using a plurality of mechanical fasteners 540 that form a quick connect/disconnect system. A plurality of separate extension plates 526, each having different heights, may be associated with a false door assembly 500. For example, a longer extension plate 526 may be used for coal charges of forty-eight tons, whereas a shorter extension plate 526 may be used for a coal charge of thirty-six tons, and no extension plate 526 might be used for a coal charge of twenty-eight tons. However, removing and replacing the extension plates 526 is labor intensive and time consuming, due to the weight of the extension plate and the fact that it is manually removed and replaced. This procedure can interrupt coke production at a facility by an hour or more.

Figure 32:
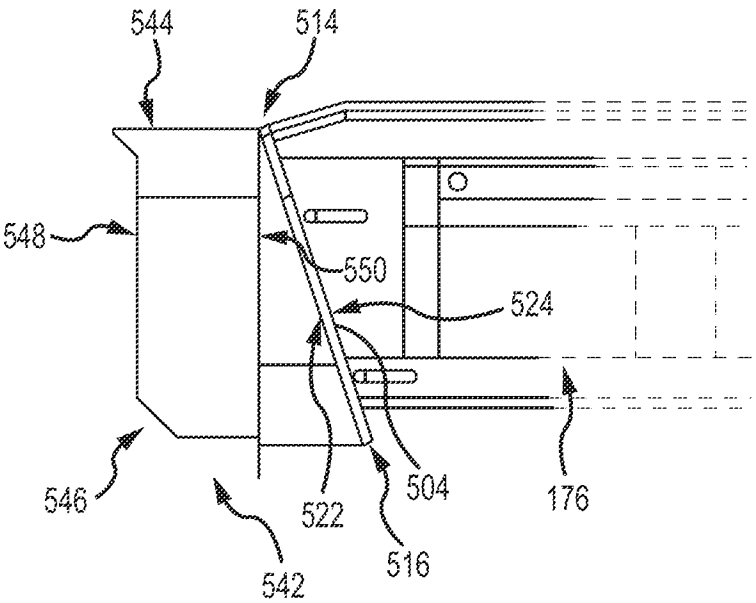
FIG. 32 depicts a side elevation view of one embodiment of a false door, according to the present technology, and further depicts one manner in which the false door may be coupled with an existing, angled false door assembly.

With reference to FIG. 32, an existing false door 504 that resides within a body plane, which is disposed at an angle away from vertical, may be adapted to have a vertical false door. In some such embodiments, a false door extension 542, having an upper end portion 544, a lower end portion 546, a front face 548, and a rearward face 550, may be operatively coupled with the false door 504. In particular embodiments, the false door extension 542 is shaped and oriented to define a replacement front face of the false door 504. It is contemplated that the false door extension 542 can be coupled with the false door 504 using mechanical fasteners, welding, or the like. In particular embodiments, the front face 548 is positioned to reside within a false door plane that is substantially vertical. In some embodiments, the front face 548 is shaped to closely mirror a contour of a refractory surface 552 of a pusher side oven door 554.

Figure 33:
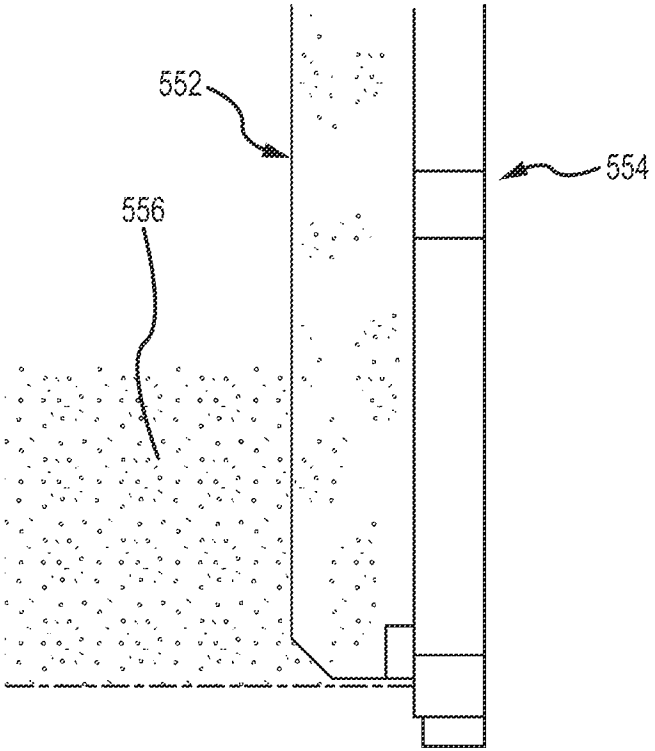
FIG. 33 depicts a side elevation view of one manner in which a coal bed may be charged into a coke oven according to the present technology.

In operation, the vertical orientation of the front face 548 allows the false door extension 542 to be placed just inside the coke oven during a coal charging operation. In this manner, as depicted in FIG. 33, an end portion of the coal bed 556 is positioned closely adjacent the refractory surface 552 of the pusher side oven door 554. Accordingly, in some embodiments, the six to twelve inch gap left between the coal bed and the refractory surface 552 can be eliminated or, at the very least, minimized significantly. Moreover, the vertically disposed front face 548 of the false door extension 542 maximizes the use of the full oven capacity to charge more coal into the oven, as opposed to the sloped bed shape created by the prior art designs, which increases the production rate for the oven. For example, if the front face 536 of the false door extension 542 is positioned twelve inches back from where the refractory surface 552 of the pusher side oven door 554 will be positioned when the coke oven is closed on a forty-eight ton coal charge, an unused oven volume equal to approximately one ton of coal is formed. Similarly, if the front face 536 of the false door extension 542 is positioned six inches back from where the refractory surface 552 of the pusher side oven door 554 will be positioned, the unused oven volume will equal approximately one half of a ton of coal. Accordingly, using the false door extension 542 and the aforementioned methodology, each oven can charge an additional half ton to a full ton of coal, which can significantly improve the coal processing rate for an entire oven battery. This is true despite the fact that a forty-nine ton charge may be placed into an oven typically operated with forty-eight ton charges. The forty-nine ton charge will not increase the forty-eight hour coke cycle. If the twelve inch void is filled using the aforementioned methodology but only forty-eight tons of coal are charged into the oven, the bed will be reduced from an expected forty-eight inches high to forty-seven inches high. Coking the forty-seven inch high coal charge for forty-eight hours buys one additional hour of soak time for the coking process, which could improve coke quality (CSR or stability).

Figure 34A:
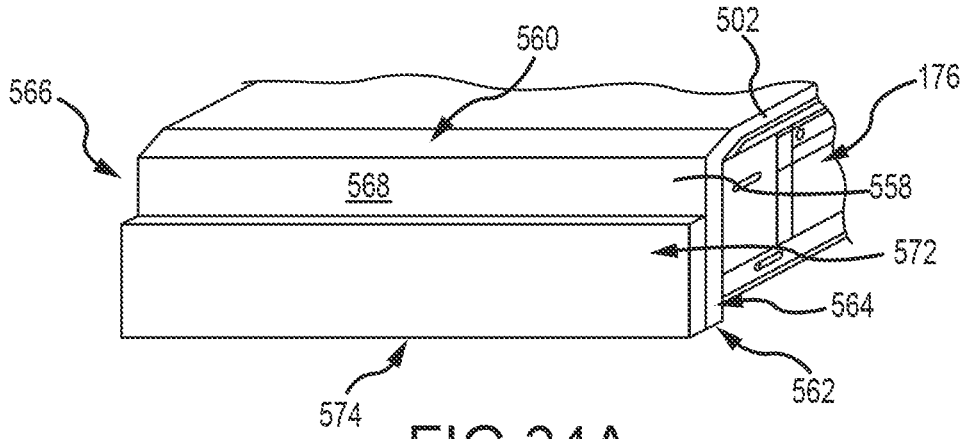
FIG. 34A depicts a front perspective view of one embodiment of a false door assembly according to the present technology.
Figure 34B:
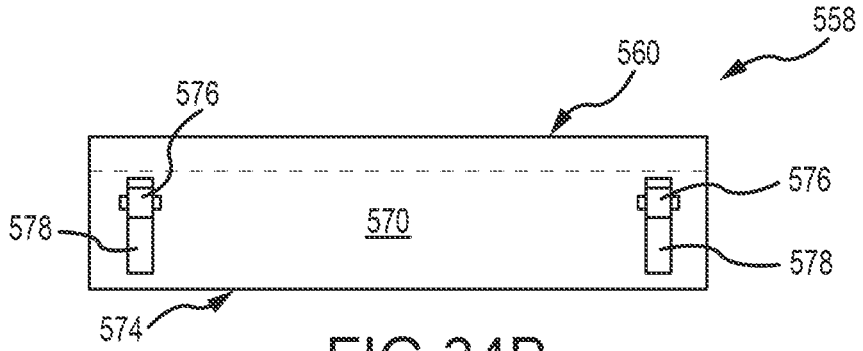
FIG. 34B depicts a rear elevation view of one embodiment of a false door that may be used with the false door assembly depicted in FIG. 34A.
Figure 34C:
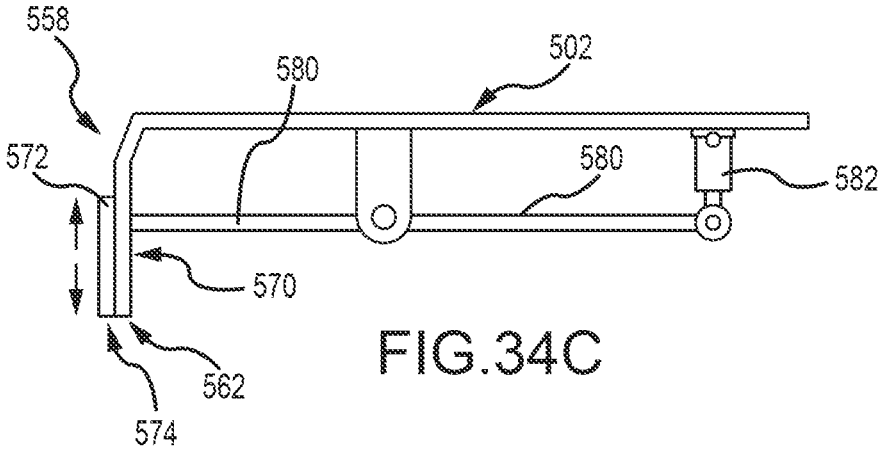
FIG. 34C depicts a side elevation view of the false door assembly depicted in FIG. 34A and further depicts one manner in which a height of the false door may be selectively increased or decreased.

In particular embodiments of the present technology, as depicted in FIGS. 34A-34C, the false door frame 502 may be fitted with a vertical false door 558, in place of the false door 504. In various embodiments, the vertical false door 558 has an upper end portion 560, a lower end portion 562, opposite side portions 564 and 566, a front face 568, and a rearward face 570. In the embodiment depicted, the front face 568 is positioned to reside within a false door plane that is substantially vertical. In some embodiments, the front face 568 is shaped to closely mirror a contour of a refractory surface 552 of a pusher side oven door 554. In this manner, the vertical false door may be used much in the same manner as that described above with regard to the false door assembly that employs a false door extension 542.

Figure 35A:
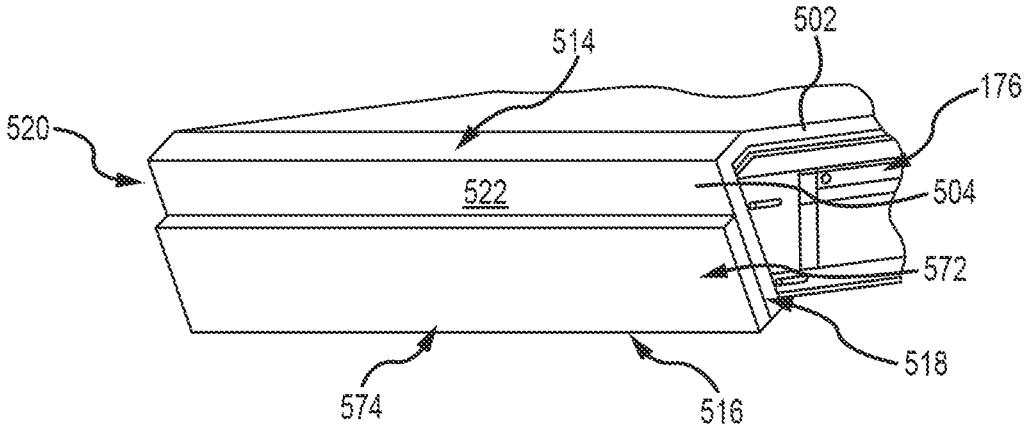
FIG. 35A depicts a front perspective view of another embodiment of a false door assembly according to the present technology.
Figure 35B:
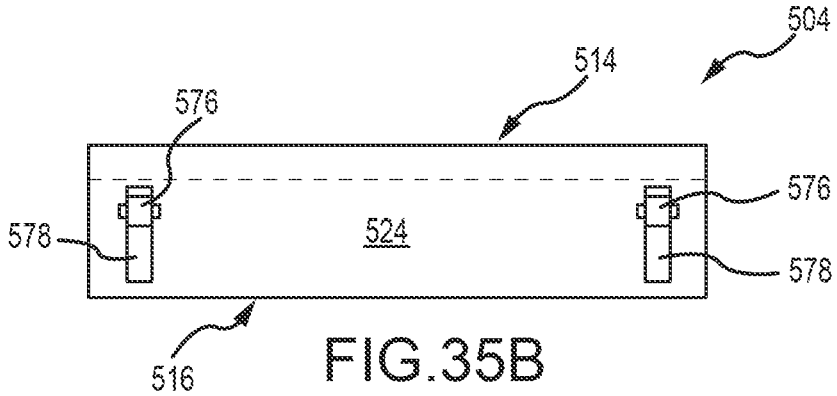
FIG. 35B depicts a rear elevation view of one embodiment of a false door that may be used with the false door assembly depicted in FIG. 35A.
Figure 35C:
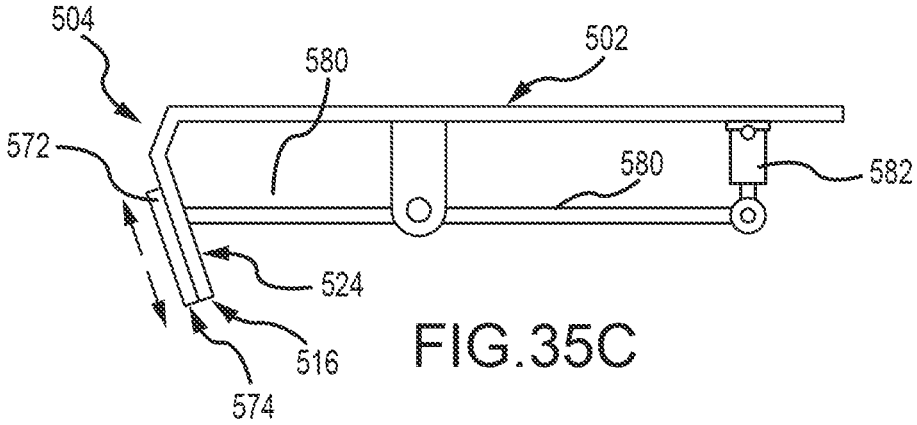
FIG. 35C depicts a side elevation view of the false door assembly depicted in FIG. 35A and further depicts one manner in which a height of the false door may be selectively increased or decreased.

It may be desirable to periodically coke successive coal beds of different bed heights. For example, an oven may be first charged with a forty-eight ton, forty-eight inch high, coal bed. Thereafter, the oven may be charged with a twenty-eight ton, twenty-eight inch high, coal bed. The different bed heights require the use of false doors of correspondingly different heights. Accordingly, with continued reference to FIGS. 34A-34C, various embodiments of the present technology provide a lower extension plate 572 coupled with the front face 568 of the vertical false door 558. The lower extension plate 572 is selectively, vertically moveable with respect to the vertical false door 558 between retracted and extended positions. At least one extended position disposes a lower edge portion 574 of the lower extension plate 572 below the lower edge portion 562 of the vertical false door 558 such that an effective height of the vertical false door 558 is increased. In some embodiments, relative movement between the lower extension plate 572 and the vertical false door 558 is effected by disposing one or more extension plate brackets 576, which extend rearwardly from the lower extension plate 572, through one or more vertically arranged slots 578 that penetrate the vertical false door 558. One of various arm assemblies 580 and power cylinders 582 may be coupled to the extension plate brackets 576 to selectively move the lower extension plate 572 between its retracted and extended positions. In this manner, the effective height of the vertical false door 558 may be automatically customized to any height, ranging from an initial height of the vertical false door 558 to a height with the lower extension plate 572 at a full extension position. In some embodiments, the lower extension plate 558 and its associated components may be operatively coupled with the false door 504, such as depicted in FIGS. 35A-35C. In other embodiments, the lower extension plate 558 and its associated components may be operatively coupled with the extension plate 526.

It is contemplated that, in some embodiments of the present technology, the end portion of the coal bed 556 may be slightly compacted to reduce the likelihood that the end portion of the coal charge will spill from the oven before the pusher side oven door 554 can be closed. In some embodiments, one or more vibration devices may be associated with the false door 504, extension plate 526, or vertical false door 558, in order to vibrate the false door 504, extension plate 526, or vertical false door 558, and compact the end portion of the coal bed 556. In other embodiments, the elongated false door frame 502 may be reciprocally and repeatedly moved into contact with the end portion of the coal bed 204 with sufficient force to compact the end portion of the coal bed 556. A water spray may also be used, alone or in conjunction with the vibratory or impact compaction methods, to moisten the end portion of the coal bed 556 and, at least temporarily, maintain a shape of the end portion of the coal bed 556 so that portions of the coal bed 556 do not spill from the coke oven.

Various embodiments of the present technology are described herein as increasing the coking rate of coking ovens in one manner or another. Many of these embodiments apply to forty-seven ton coal charges that are commonly coked in a forty-eight hour period, processing coal at a rate of approximately 0.98 tons/hr. One or more of the aforementioned technology improvements may increase the density of the coal charge, thereby, allowing an additional one or two tons of coal to be charged into the oven without increasing the forty-eight hour coking time. This results in a coal processing rate of 1.00 tons/hr. or 1.02 tons/hr.

In another embodiment, however, coal processing rates can be increased by twenty percent or more over a forty-eight hour period. In an exemplary embodiment, a coal charging system 100, having an elongated charging frame 102 and a charging head 104 coupled with the distal end portion of the elongated charging frame 102, is positioned at least partially within a coke oven. The coke oven is at least partially defined by a maximum designed coal charge capacity (volume per charge). In some embodiments, the maximum designed coal charge capacity is defined as the maximum volume of coal that can be charged into a coke oven according to the width and length of a coke oven multiplied by a maximum bed height, which is typically defined by a height of downcomer openings, formed in the coke oven's opposing side walls, above the coke oven floor. The volume will further vary according to the density of the coal charge throughout the coal bed. The maximum coal charge of the coke oven is associated with a maximum coking time (the designed coking time associated with the designed coal volume per charge). The maximum coking time is defined as the longest amount of time in which the coal bed may be fully coked. The maximum coking time is, in various embodiments, constrained by the amount of volatile matter within the coal bed that may be converted into heat over the duration of the coking process. Further constraints on the maximum coking time include the maximum and minimum coking temperatures of the coking oven being used, as well as the density of the coal bed and the quality of coal being coked. The coal is charged into the coke oven with the coal charging system 100 in a manner that defines a first operational coal charge that is less than the maximum coal charge capacity. The first operational coal charge is coked in the coke oven until it is converted into a first coke bed over a first coking time that is less than the maximum coking time. The first coke bed is then pushed from the coke oven. More coal may then be charged into the coke oven by the coal charging system to define a second operational coal charge that is less than the maximum coal charge capacity. The second operational coal charge is coked in the coke oven until it is converted into a second coke bed over a second coking time that is less than the maximum coking time. The second coke bed may then be pushed from the coke oven. In many embodiments, a sum of the first operational coal charge and the second operational coal charge exceeds a weight of the maximum coal charge capacity. In some such embodiments, a sum of the first coking time and the second coking time are less than the maximum coking time. In various embodiments, the first operational coal charge and second operational coal charge have individual weights that are at least more than half of the weight of the maximum coal charge capacity. In particular embodiments, the first operational coal charge and second operational coal charge each have a weight of between 24 and 30 tons. In various embodiments, the duration of each of the first coking time and second coking time approximates half of the maximum coking time or less. In particular embodiments, the sum of the first coking time and the second coking time is 48 hours or less.

In one embodiment, the coke oven is charged with approximately twenty-eight and one half tons of coal. The charge is fully coked over a twenty-four hour period. Once complete, the coke is pushed from the coke oven and a second coal charge of twenty-eight and one half tons is charged into the coke oven. Twenty-four hours later, the charge is fully coked and pushed from the oven. Accordingly, one oven has coked fifty-seven tons of coal in forty-eight hours, providing a coal processing rate of 1.19 ton/hour for a twenty-one percent increase. However, testing has shown that attaining the rate increase, without significantly reducing coke quality, requires oven control (burn efficiency and thermal management to maintain oven thermal energy), and coal charging techniques that balance oven heat from one end of the bed to the other.

Figure 36:
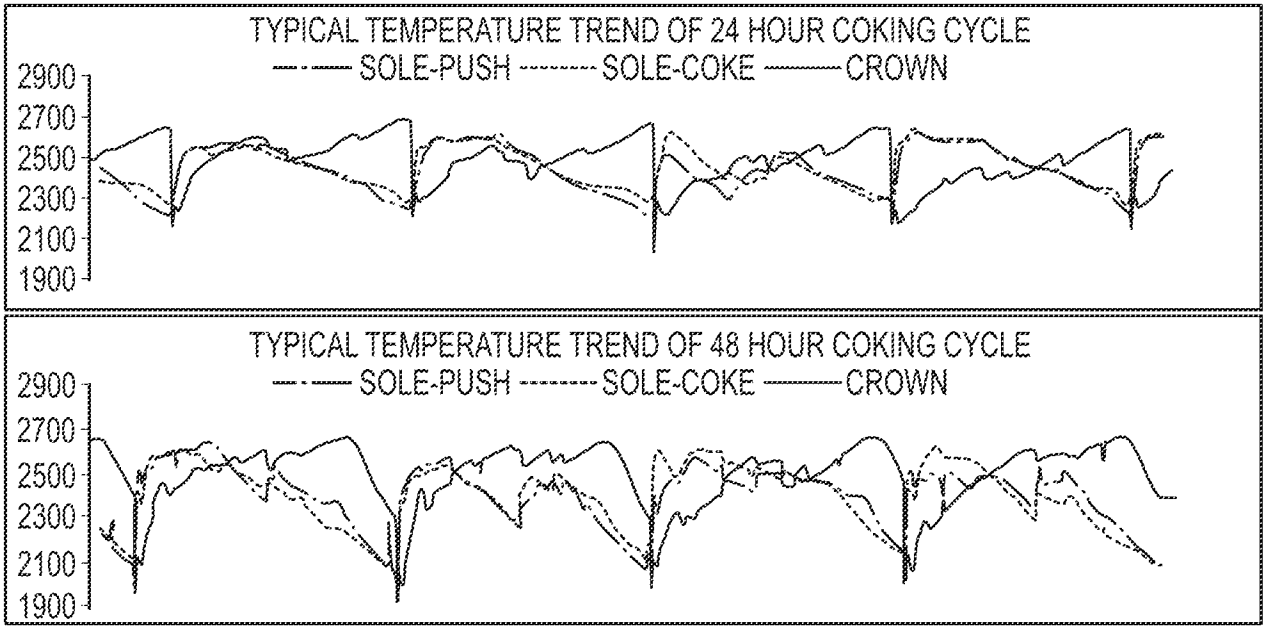
FIG. 36 depicts two graphs comparatively, wherein the two graphs plot coke oven sole and crown temperatures over time for a twenty-four hour coking cycle and a forty-eight hour coking cycle.

With reference to FIG. 36, a comparison of the oven burning profiles for twenty-four hour and forty-eight hour coking cycles reveals differences in the characteristics of the two burn profiles. One significant difference between the two burn profiles is the crossover time between the crown and sole flue temperatures. Specifically, the crossover time is longer in a twenty-four hour coking cycle, which tries to reserve more heat in the oven, both for the current coking cycle and to maintain high oven heat for the next coking cycle. Reducing the charge from forty-seven tons (typically forty-seven inches in height) to twenty-eight and one half tons (twenty-eight and one half inches) significantly decreases oven volume occupied by the coal bed. Therefore, an oven that is charged with a lighter bed of coal will have less volatile material to burn over the coking cycle. Accordingly, maintaining proper heat levels in the oven is an issue for twenty-four hour coking cycles.

With continued reference to FIG. 36, the oven startup temperature is generally higher for twenty-four hour coking cycles (greater than 2,100° F.) than forty-eight hour coking cycles (less than 2,000° F.). In various embodiments, the heat may be maintained over the coking cycle by controlling the release of the volatile material from the coal bed. In one such embodiment, uptake dampers are precisely controlled to adjust oven draft. In this manner, the oxygen intake of the oven, and combustion of the volatile material, may be managed to ensure that the supply of volatile material is not exhausted too early in the coking cycle. As depicted in FIG. 36, the twenty-four hour cycle maintains a higher average cycle temperature than that for the forty-eight hour cycle. Because the temperatures in a twenty-four hour cycle start higher than in a forty-eight hour cycle, more volatile material is drawn into the sole flue and combusted, which increases the sole flue temperatures over those in a forty-eight hour cycle. The increased sole flue temperatures of the twenty-four hour cycle further benefit coal processing rate, coke quality, and available exhaust heat that may be used in steam/power generation.

Properly charging a coke oven, previously used to coke a forty-seven ton charge of coal, with a twenty-eight to thirty ton charge requires changes to the coal charging system 100 and the manner in which it is used. A thirty ton charge of coal is typically eighteen to twenty inches shorter than a forty-seven ton charge. In order to charge an oven with thirty tons of coal, or less, the coal charging system should be lowered, oftentimes, to its lowest point. However, when the coal charging system 100 is lowered, the false door assembly 500 must also be lowered so that it may continue to block coal from falling out of the oven during the charging operation. Accordingly, with reference to FIGS. 34A-34C, the power cylinder 582 is actuated to engage the arm assemblies 580 and retract the lower extension plate 572 with respect to the front face 568 of the vertical false door 558. The lower extension plate 572 is retracted until the vertical false door 558 is properly sized to be disposed between the coal charging system 100 and the floor of the coke oven, adjacent the pusher side oven door 554.

Testing has shown that charging an oven with a relatively thin coal charge of thirty tons or less results in a lower chain pressure than that generated in charging a forty-seven ton coal bed. In particular, initial testing of thirty ton coal charges demonstrated a chain pressure of 1600 psi to 1800 psi, which is significantly less than the 2800 psi chain pressure that can be attained when charging forty-seven ton coal beds. Oftentimes, the operator of the coal charging system is not able to charge the coal evenly across the oven (front to back and side to side) or maintain an even bed density. These factors can result in uneven coking and lower quality coke. In particular embodiments, these ill effects were lessened where a chain pressure of 1900 psi to 2100 psi was maintained. This chain pressure range produced coal beds that were more square and even.

The process of coking coal charges of thirty tons or less in twenty-four hours has, therefore, been shown to benefit coke production capacity by making more coke over a forty-eight hour period than traditional forty-eight hour coking processes. However, initial testing demonstrated that some of the coke being produced in the twenty-four hour cycle exhibited lower quality (CSR, stability & coke size). For example, some tests showed that CSR dropped by approximately three points from 63.5 for a forty-eight hour cycle to 60.8 for a twenty-four hour cycle.

Figure 37:
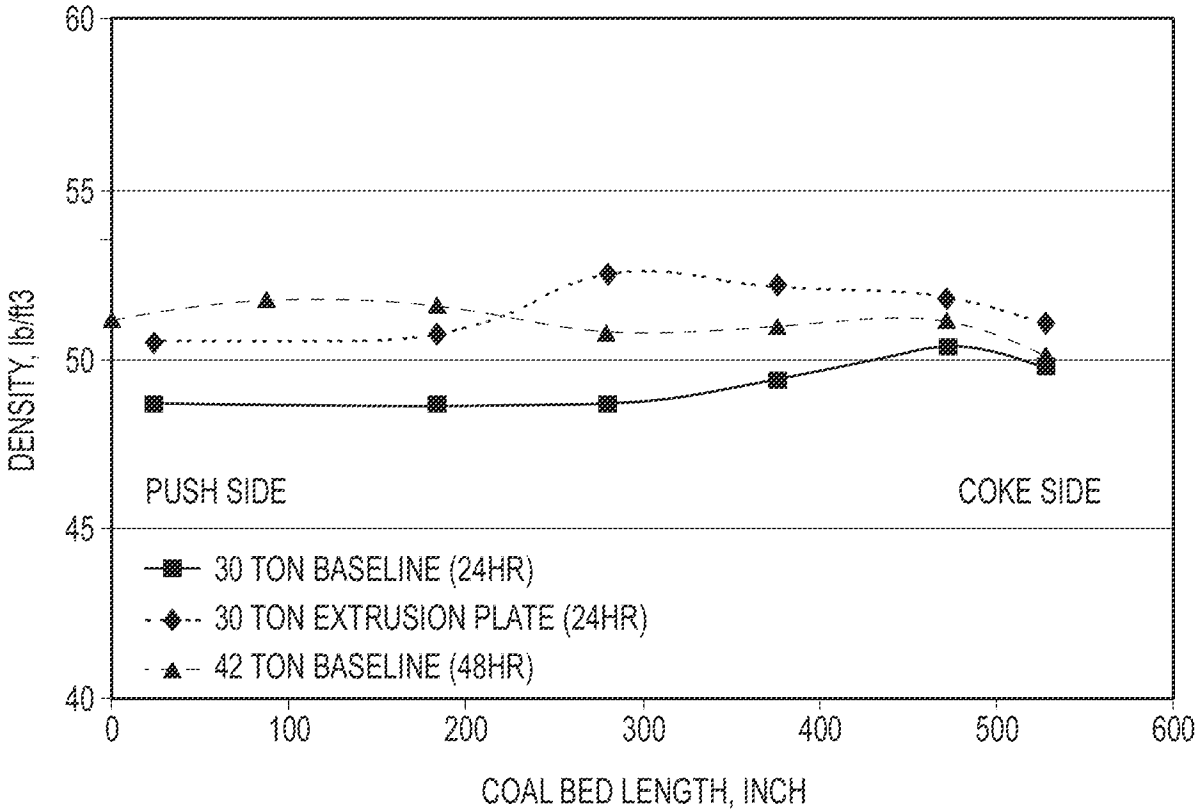
FIG. 37 depicts a plot of coal bed densities over a length of a coal bed for a thirty ton coal charge baseline coked over twenty-four hours, a thirty ton coal charge that has been at least partially extruded, according to the present technology, over twenty-four hours, and a forty-two ton coal charge baseline coked over forty-eight hours.

In some embodiments, the coke quality was improved by charging the coal bed of thirty tons or less using a coal charging system 100 having an extrusion plate 166. As described in greater detail above, loose coal is conveyed into the coal charging system 100 behind the charging head 104 and engages the coal engagement face 168. The coal engagement face 168 compacts the coal downwardly, into the coal bed. The pressure of the coal being deposited behind the charging head 104 increases the density of the coal bed beneath the extrusion plate 166. FIG. 37 depicts at least some of the density increasing benefits attributable to the extrusion plate 166. In tests involving a thirty ton non-extruded coal bed, a thirty ton extruded coal bed, and a forty-two ton non-extruded coal bed, the extruded coal bed exhibited a bed density that was consistently higher than the non-extruded coal bed of the same weight. In fact, the extruded coal bed weighing thirty tons had a density that was similar to better than the forty-two ton coal bed. Extruding the smaller coal beds generally lowers the bed height by approximately one inch, while maintaining the same charge weight. Accordingly, the bed receives the added benefit of an additional hour for soak time. Further testing of the sample indicated that the higher coal bulk density improved the soak time of the bed, as well as the resulting coke stability, CSR, and coke size.

Figure 38:
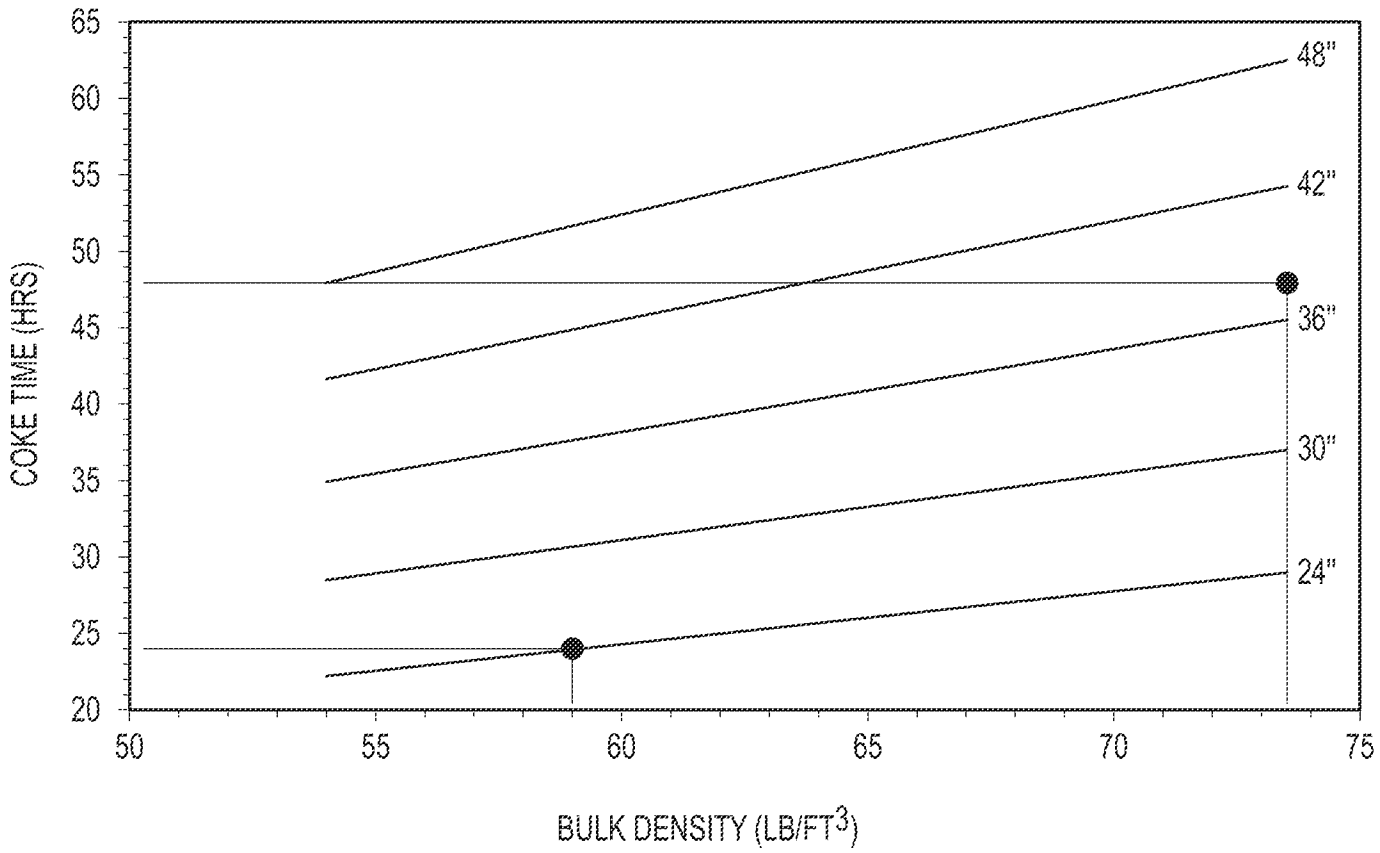
FIG. 38 depicts a plot of coking time over coal bed density for coal beds of charge heights of twenty-four inches, thirty inches, thirty-six inches, forty-two inches, and forty-eight inches.
Figure 39:
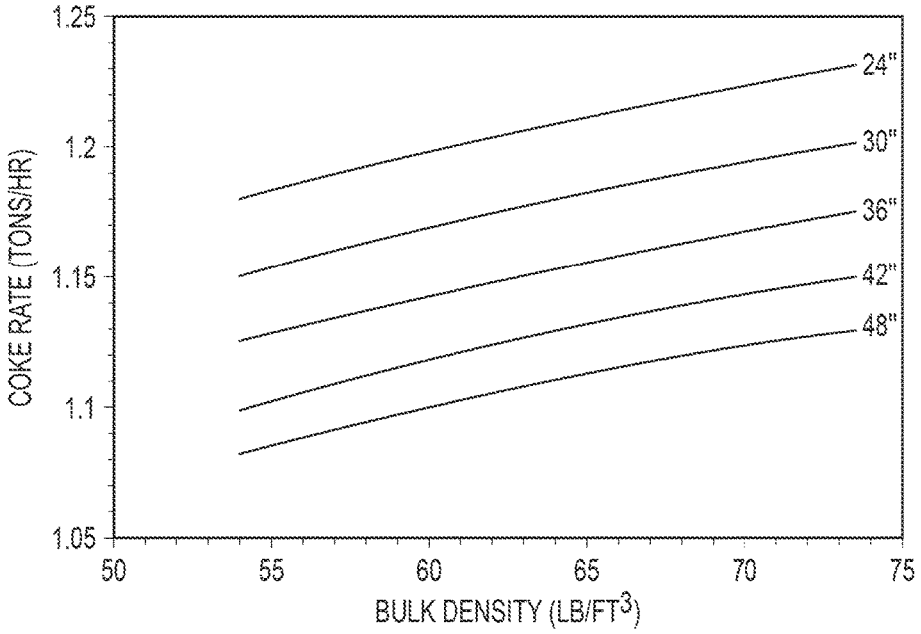
FIG. 39 depicts a plot of coal processing rate over coal bed bulk density for coal beds of charge heights of twenty-four inches, thirty inches, thirty-six inches, forty-two inches, and forty-eight inches.
Figure 40:
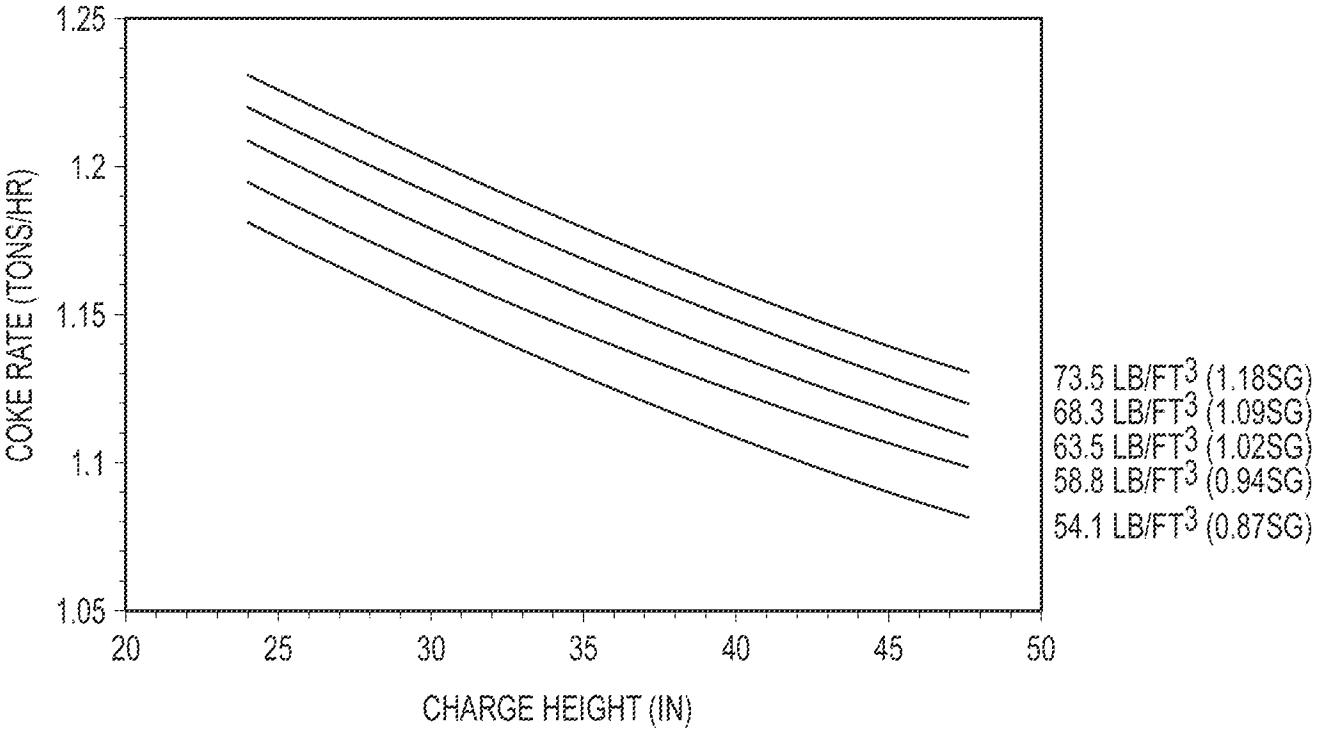
FIG. 40 depicts a plot of coal processing rate over coal bed charge height for a variety of coal bed different bulk densities.

With reference to FIG. 38, coking time is plotted against coal bed density for coal beds of five different heights. The data demonstrates the increase in production rate through the use of the present technology. As depicted, a first coal bed, having a height of 37.7 inches, a weight of 56.0 tons, and a bed density of 73.5 lbs./cu. ft. was fully coked in forty-eight hours. This provides a coking rate of 1.167 tons per hour. A second coal bed, having a height of 24.0 inches, a weight of nearly 28.7 tons, and a bed density of 59.2 lbs./cu. ft. was fully coked in twenty-four hours. This provides a coking rate of 1.196 tons per hour. The trend can be also be followed for coal beds of charge heights of thirty inches, thirty-six inches, forty-two inches, and forty-eight inches. With reference to FIG. 39, coal processing rate is plotted against bulk density for coal beds of charge heights of thirty inches, thirty-six inches, forty-two inches, and forty-eight inches. As can be seen, the combination of shorter charge bed heights and increased bed density maximizes coal processing rate. This is further reflected in FIG. 40, where coal processing rate is plotted against charge height for a variety of coal bed different bulk densities.

Examples

The following Examples are illustrative of several embodiments of the present technology.

1. A method of increasing a coal processing rate of a coke oven, the method comprising:
   - positioning a coal charging system, having an elongated charging frame and a charging head operatively coupled with the distal end portion of the elongated charging frame, at least partially within a coke oven having a maximum coal charge capacity and a maximum coking time associated with the maximum coal charge;
   - charging coal into the coke oven with the coal charging system in a manner that defines a first operational coal charge that is less than the maximum coal charge capacity;
   - coking the first operational coal charge in the coke oven until it is converted into a first coke bed but over a first coking time that is less than the maximum coking time;
   - pushing the first coke bed from the coke oven;
   - charging coal into the coke oven with the coal charging system in a manner that defines a second operational coal charge that is less than the maximum coal charge capacity;
   - coking the second operational coal charge in the coke oven until it is converted into a second coke bed but over a second coking time that is less than the maximum coking time; and
   - pushing the second coke bed from the coke oven;
   - a sum of the first operational coal charge and the second operational coal charge exceeds a weight of the maximum coal charge capacity;
   - a sum of the first coking time and the second coking time being less than the maximum coking time.

2. The method of claim 1 wherein the first operational coal charge has a weight that is more than half of the weight of the maximum coal charge capacity.

3. The method of claim 2 wherein the second operational coal charge has a weight that is more than half of the weight of the maximum coal charge capacity.

4. The method of claim 1 wherein the first operational coal charge and second operational coal charge each have a weight of between 24 and 30 tons.

5. The method of claim 1 wherein the duration of the first coking time approximates half of the maximum coking time.

6. The method of claim 5 wherein the duration of the second coking time approximates half of the maximum coking time.

7. The method of claim 1 wherein the sum of the first coking time and the second coking time is 48 hours or less.

8. The method of claim 7 wherein a sum of the first operational coal charge and the second operational coal charge exceeds 48 tons.

9. The method of claim 1 further comprising:
   - extruding at least portions of the coal being charged into the coke oven by engaging the portions of the coal with an extrusion plate operatively coupled with a rearward face of the charging head, such that the portions of coal are compressed beneath a coal engagement face that is oriented to face rearwardly and downwardly with respect to the charging head.

10. The method of claim 9 wherein the extrusion plate is shaped to include opposing side deflection faces that are oriented to face rearwardly and laterally with respect to the charging head and portions of the coal are extruded by the opposing side deflection faces.

11. The method of claim 1 further comprising:

gradually withdrawing the coal charging system so that a portion of the coal flows through a pair of opposing wing openings that penetrate lower side portions of the charging head and engage a pair of opposing wings having free end portions positioned in a spaced-apart relationship, forwardly from a front face of the charging head, such that the portion of the coal is directed toward side portions of a coal bed being formed by the coal charging system.

12. The method of claim 11 further comprising:

compressing portions of the coal bed beneath the opposing wings by engaging elongated densification bars, which extend along a length of, and downwardly from, each of the opposing wings, with the portions of the coal bed as the coal charging system is withdrawn.

13. The method of claim 1 further comprising:

supporting a rearward portion of the coal bed with a false door system having a generally planar false door that is operatively coupled with a distal end portion of an elongated false door frame.

14. The method of claim 13 wherein the false door is substantially vertically disposed and a face of the rearward end portion of the coal bed is: (i) shaped to be substantially vertical; and (ii) positioned closely adjacent a refractory surface of an oven door associated with the coke oven after the coal bed is charged and the oven door is coupled with the coke oven.

15. The method of claim 13 further comprising:

vertically moving a lower extension plate that is operatively coupled with the front face of the false door, to a retracted position that disposes a lower edge portion of the lower extension plate no lower than a lower edge portion of the false door and decreases an effective height of the false door, prior to supporting the rearward portion of the coal bed.

16. A method of increasing a coal processing rate of a coke oven, the method comprising:

charging a bed of coal into a coke oven in a manner that defines an operational coal charge; the coke oven having a designed coal processing rate that is defined by a designed coal charge and a designed coking time associated with the designed coal charge; the operational coal charge being less than the designed coal charge;

coking the operational coal charge in the coke oven over an operational coking time to define an operational coal processing rate; the operational coking time being less than the designed coking time; wherein the operational coal processing rate is greater than the designed coal processing rate.

17. The method of claim 16 wherein the operational coal charge has a thickness that is less than a thickness of the designed coal charge.

18. The method of claim 16 wherein coking the operational coal charge in the coke oven produces a volume of coke over the operational coking time to define an operational coke production; the operational coke production rate being greater than a designed coke production rate for the coke oven.

19. A method of increasing a coal processing rate of a horizontal heat recovery coke oven, the method comprising:

charging coal into a coke oven with a coal charging system in a manner that defines a first operational coal charge that weighs between 24 and 30 tons;

coking the first operational coal charge in the coke oven until it is converted into a first coke bed but over a first coking time that is no more than 24 hours;

pushing the first coke bed from the coke oven; charging coal into the coke oven with the coal charging system in a manner that defines a second operational coal charge that weighs between 24 and 30 tons;

coking the second operational coal charge in the coke oven until it is converted into a second coke bed but over a second coking time that is no more than 24 hours; and pushing the second coke bed from the coke oven.

20. The method of claim 19 further comprising:

extruding at least portions of the coal being charged into the coke oven with the coal charging system by engaging the portions of the coal with an extrusion plate operatively coupled with a rearward face of a charging head associated with the coal charging system, such that the portions of coal are compressed beneath the extrusion plate.

21. A method of increasing a coal processing rate of a coke oven, having a designed coal volume per charge and a designed coking time associated with the designed coal volume per charge, the method comprising:

charging coal into the coke oven in a manner that defines a first operational coal charge that is less than the designed coal volume per charge;

coking the first operational coal charge in the coke oven until it is converted into a first coke bed but over a first coking time that is less than the designed coking time;

pushing the first coke bed from the coke oven;

charging coal into the coke oven in a manner that defines a second operational coal charge that is less than the designed coal volume per charge;

coking the second operational coal charge in the coke oven until it is converted into a second coke bed but over a second coking time that is less than the designed coking time; and pushing the second coke bed from the coke oven;

a sum of the first operational coal charge and the second operational coal charge exceeding a weight of the designed coal volume per charge;

a sum of the first coking time and the second coking time being less than the designed coking time.

22. The method of claim 21 wherein the coke oven has a designed average coke oven temperature over the designed coking time and the step of coking the first operational coal charge generates an average coke oven temperature that is higher than the designed average coke oven temperature.

23. The method of claim 21 wherein the coke oven has a designed average sole flue temperature over the designed coking time and the step of coking the first operational coal charge generates an average sole flue temperature that is higher than the designed average coke oven temperature.

Although the technology has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

We claim:

1. A method of increasing a coal processing rate of a coke oven, the method comprising:

positioning a coal charging system, having an elongated charging frame and a charging head operatively coupled with a distal end portion of the elongated charging frame, at least partially within a coke oven having a maximum designed coal charge capacity, defined as a maximum volume of coal that can be charged into the coke oven according to a width and length of the coke oven multiplied by a maximum bed height, defined by a height of downcomer openings, formed in opposing side walls of the coke oven, above a coke oven floor, and a maximum designed coking time associated with the maximum designed coal charge, wherein the maximum designed coking time is defined as the amount of time required to fully coke the maximum designed coal charge;

charging coal into the coke oven with the coal charging system in a manner that defines a first operational coal charge that is less than the maximum designed coal charge capacity;

gradually withdrawing the coal charging system so that a portion of the coal flows through a pair of opposing wing openings that penetrate lower side portions of the charging head, after which the coal engages the pair of opposing wings having free end portions positioned forward from a front face of the charging head, in a spaced-apart relationship with the charging head, such that the portion of the coal is directed by the wings toward side portions of a coal bed being formed by the coal charging system;

compressing portions of the coal bed beneath the opposing wings by engaging the portions of the coal bed with elongated densification bars, which extend along a length of, and downwardly from, each of the opposing wings, as the coal charging system is withdrawn;

coking the first operational coal charge in the coke oven until it is converted into a first coke bed but over a first coking time that is less than the maximum designed coking time;

pushing the first coke bed from the coke oven;

charging coal into the coke oven with the coal charging system in a manner that defines a second operational coal charge that is less than the maximum designed coal charge capacity;

coking the second operational coal charge in the coke oven until it is converted into a second coke bed but over a second coking time that is less than the maximum designed coking time; and pushing the second coke bed from the coke oven;

a sum of the first operational coal charge and the second operational coal charge exceeds a weight of the maximum designed coal charge capacity;

a sum of the first coking time and the second coking time being equal to or less than the maximum designed coking time.

2. The method of claim 1 wherein the first operational coal charge has a weight that is more than half of the weight of the maximum coal charge capacity.

3. The method of claim 2 wherein the second operational coal charge has a weight that is more than half of the weight of the maximum coal charge capacity.

4. The method of claim 1 wherein the first operational coal charge and second operational coal charge each have a weight of between 24 and 30 tons.

5. The method of claim 1 wherein the duration of the first coking time approximates half of the maximum designed coking time.

6. The method of claim 5 wherein the duration of the second coking time approximates half of the maximum designed coking time.

7. The method of claim 1 wherein the sum of the first coking time and the second coking time is 48 hours or less.

8. The method of claim 7 wherein a sum of the first operational coal charge and the second operational coal charge exceeds 48 tons.

9. The method of claim 1 further comprising:

extruding at least portions of the coal being charged into the coke oven by engaging the portions of the coal with an extrusion plate operatively coupled with a rearward face of the charging head, such that the portions of coal are compressed beneath a coal engagement face that is oriented to face rearwardly and downwardly with respect to the charging head.

10. The method of claim 9 wherein the extrusion plate is shaped to include opposing side deflection faces that are oriented to face rearwardly and laterally with respect to the charging head and portions of the coal are extruded by the opposing side deflection faces.

11. The method of claim 1 further comprising:

supporting a rearward portion of the coal bed with a false door system having a generally planar false door that is operatively coupled with a distal end portion of an elongated false door frame.

12. The method of claim 11 wherein the false door is substantially vertically disposed and a face of the rearward end portion of the coal bed is: (i) shaped to be substantially vertical; and (ii) positioned closely adjacent a refractory surface of an oven door associated with the coke oven after the coal bed is charged and the oven door is coupled with the coke oven.

13. The method of claim 11 further comprising:

vertically moving a lower extension plate that is operatively coupled with the front face of the false door, to a retracted position that disposes a lower edge portion of the lower extension plate no lower than a lower edge portion of the false door and decreases an effective height of the false door prior to supporting the rearward portion of the coal bed.

* * * * *